US010272297B2

(12) United States Patent
Mizutani

(10) Patent No.: US 10,272,297 B2
(45) Date of Patent: Apr. 30, 2019

(54) GOLF CLUB

(71) Applicant: DUNLOP SPORTS CO. LTD., Kobe-shi, Hyogo (JP)

(72) Inventor: Naruhiro Mizutani, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 14/747,838

(22) Filed: Jun. 23, 2015

(65) Prior Publication Data

US 2015/0367188 A1 Dec. 24, 2015

(30) Foreign Application Priority Data

Jun. 24, 2014 (JP) ..... 2014-128933

(51) Int. Cl.
*A63B 53/02* (2015.01)
*A63B 53/04* (2015.01)

(52) U.S. Cl.
CPC ..... *A63B 53/02* (2013.01); *A63B 53/0466* (2013.01); *A63B 2053/022* (2013.01); *A63B 2209/00* (2013.01); *A63B 2225/093* (2013.01)

(58) Field of Classification Search
CPC ..... A63B 53/02; A63B 2053/023; A63B 2053/028
USPC ..... 473/305, 307–310
See application file for complete search history.

(56) References Cited

U.S. PATENT DOCUMENTS 1,623,523 A * 4/1927 Bourke ..... A63B 53/02 473/307
3,524,646 A * 8/1970 Wheeler ..... A63B 53/007 473/288
4,852,782 A * 8/1989 Wu ..... A63B 53/02 206/315.2
6,033,318 A * 3/2000 Drajan, Jr. ..... A63B 53/02 473/309
6,547,673 B2 * 4/2003 Roark ..... A63B 53/02 473/239
7,316,622 B1 * 1/2008 Lucas ..... A63B 53/007 473/239
7,887,431 B2 * 2/2011 Beach ..... A63B 53/02 473/307
8,758,153 B2 * 6/2014 Sargent ..... A63B 53/02 473/246

(Continued)

FOREIGN PATENT DOCUMENTS

JP 2008-29691 A 2/2008
JP 2014-36809 A 2/2014

OTHER PUBLICATIONS

Office Action issued in Japanese Application No. 2014-128933 dated Mar. 6, 2018.

*Primary Examiner* — William M Pierce
(74) *Attorney, Agent, or Firm* — Birch, Stewart, Kolasch & Birch LLP

(57) ABSTRACT

A golf club according to one aspect of the present invention includes a shaft, a golf club head including a hosel containing a hole to attach the shaft, and a sleeve system including a body attached to a tip of the shaft and inserted together with the shaft into the hole of the hosel and an adaptor attached to the body so as to enable an adjustment of an axis-directional position with respect to the body and engaging with an upper end of the hosel.

2 Claims, 23 Drawing Sheets

(56) References Cited

U.S. PATENT DOCUMENTS 8,808,104 B2 * 8/2014 Foster ..... A63B 53/02 473/288
8,939,847 B2 * 1/2015 Sander ..... A63B 53/02 473/246
9,022,879 B2 5/2015 Sato
9,050,507 B2 * 6/2015 Boyd ..... A63B 53/02
2005/0227777 A1 * 10/2005 Cover ..... A63B 53/065 473/251
2006/0287125 A1 * 12/2006 Hocknell ..... A63B 53/00 473/309
2006/0293116 A1 * 12/2006 Hocknell ..... A63B 53/00 473/305
2007/0078026 A1 * 4/2007 Holt ..... A63B 53/00 473/305
2009/0181792 A1 * 7/2009 Burch ..... A63B 53/02 473/309
2009/0286618 A1 * 11/2009 Beach ..... A63B 53/02 473/307
2010/0197423 A1 * 8/2010 Thomas ..... A63B 53/02 473/307
2010/0197424 A1 * 8/2010 Beach ..... A63B 53/02 473/307
2011/0021281 A1 * 1/2011 Sander ..... A63B 53/02 473/288
2011/0111881 A1 * 5/2011 Sander ..... A63B 53/02 473/307
2011/0190072 A1 * 8/2011 Beach ..... A63B 53/02 473/307
2012/0071261 A1 * 3/2012 Yamamoto ..... A63B 53/02 473/307
2012/0100926 A1 * 4/2012 Golden ..... A63B 53/02 473/307
2012/0225729 A1 * 9/2012 Burch ..... A63B 53/02 473/307
2012/0316006 A1 * 12/2012 Kitagawa ..... A63B 53/02 473/307
2013/0017901 A1 * 1/2013 Sargent ..... A63B 53/0466 473/309
2013/0059676 A1 * 3/2013 Boyd ..... A63B 53/02 473/307
2013/0085010 A1 * 4/2013 Beach ..... A63B 53/02 473/307
2014/0031139 A1 * 1/2014 Johnson ..... A63B 53/02 473/307
2014/0121035 A1 * 5/2014 Nivanh ..... A63B 53/00 473/309
2015/0005093 A1 * 1/2015 Motokawa ..... A63B 53/02 473/307
2015/0031469 A1 * 1/2015 Yamasawa ..... A63B 53/02 473/307
2015/0038253 A1 * 2/2015 Mizutani ..... A63B 53/02 473/307
2015/0231452 A1 * 8/2015 Boggs ..... A63B 53/02 473/307
2015/0231453 A1 * 8/2015 Harbert ..... A63B 53/02 473/307
2015/0273285 A1 * 10/2015 Burch ..... A63B 53/02 473/307
2015/0343279 A1 * 12/2015 Mizutani ..... A63B 53/02 473/307
2016/0059093 A1 * 3/2016 Nielson ..... A63B 53/02 473/338

* cited by examiner

GOLF CLUB

CROSS REFERENCE

This application claims priority to Japanese Patent Application No. 2014-128933 filed on Jun. 24, 2014, which is hereby incorporated by reference in its entirety.

FIELD

The present invention relates to a golf club.

BACKGROUND

A variety of methods for joining a golf club head and a shaft together have been proposed over the recent years. For example, a golf club (Japanese Patent Application Laid-Open Publication No. 2008-029691) exists, which is configured to make variable a length from a grip to a golf club head (which will hereinafter be also termed a "club length") by enabling a variation of a depth at which the shaft is inserted into a hosel.

This golf club is specifically configured as below. A cylindrical collar member is attached to a tip of the shaft. Two engaging protrusions are provided at spacing through 180 degrees on an outer peripheral surface of the collar member. On the other hand, the golf club head is provided with a hosel including a shaft securing hole. An upper inner peripheral surface of the shaft securing hole is formed with two recessed portions each having a first through third stepped receiving portions to receive the engaging protrusions of the collar member in an axial direction.

To be specific, the receiving portions are different in axis-directional position to receive the engaging protrusions. The depth (an axis-directional length) at which the shaft is inserted into the hosel can be therefore adjusted by selecting the receiving portion to receive the engaging protrusion of the collar member in the axial direction while rotating the shaft in a periaxial direction. This contrivance enables the golf club to vary the club length.

SUMMARY

The golf club is configured to secure the shaft in the axial direction by inserting the collar member formed with the engaging protrusions into the shaft securing holt of the hosel, and causing the engaging protrusions of the collar member to abut on the receiving portions of the shaft securing hole. Consequently, a problem is that a portion (neck) for joining the golf club head and the shaft together has a diameter resulting in an increase corresponding to a dimension for forming the recessed portion to receive the engaging protrusion.

A golf club according to one aspect of the present invention includes a shaft, a golf club head including a hosel containing a hole to attach the shaft, and a sleeve system to including a body attached to a tip of the shaft and inserted together with the shaft into the hole of the hosel and an adaptor attached to the body so as to enable an adjustment of an axis-directional position with respect to the body and engaging with an upper end of the hosel.

The golf club having the configuration described above includes the sleeve system attached to the tip of the shaft, the sleeve system containing the body and the adaptor. The body of the sleeve system is inserted into the hole of the hosel, while the adaptor engages with the upper end of the hosel. The shaft of the golf club having the configuration described above is thereby secured in the axial direction. To be specific, a depth at which the shaft is inserted into the hosel, in other words, a position for securing the shaft in the axial direction is specified based on a position of the adaptor with respect to the body in the axial direction.

The adaptor of the golf club having the configuration described above is configured to make a position of its being attached to the body adjustable in the axial direction. The configuration described above therefore enables a variation of the club length by adjusting the axis-directional position of the adaptor with respect to the body and also adjusting an axis-directional securing position of the shaft.

With the configuration described above, the adaptor engages with the upper end of the hosel, thereby specifying the axis-directional securing position of the shaft. In other words, the system for specifying the axis-directional securing position of the shaft is provided in not an interior but an exterior of the hole of the hosel, and can therefore restrain a diameter of a neck from increasing. With the configuration described above, it is feasible to provide a golf club configured to enable the club length to vary with a simple structure so as not to increase the diameter of the neck.

In another mode of the golf club according to one aspect, the adaptor may be configured in a cylindrical shape so as to attach to an outer peripheral surface of the body. An inner peripheral surface of the adaptor may be formed with engaging portions extending in an axial direction. A plurality of engaged portions, with which the engaging portions of the adaptor engage in a rotation-disabled manner in a periaxial direction, may be formed in an outer peripheral surface of the body. Further, the engaging portion selectively may engage with one of the plurality of engaged portions to enable the adaptor to vary the axis-directional position with respect to the body. The adaptor may be configured not to come off the body in such a direction as to separate from the hosel upon engagement of the engaging portion of the adaptor with one of the plurality of engaged portions. With the configuration described above, it is feasible to provide the sleeve system with a simple structure to make the adaptor detachably attachable in the axial direction.

Note that the engaging portion formed on or in the inner peripheral surface of the adaptor may be configured as a protrusion protruding inward, e.g., in a radial direction and may also be configured as a groove being recessed outward in the radial direction. With the engaging portion being configured as the protrusion, the engaged portion formed in the outer peripheral surface of the body may also be configured as a groove being recessed inward in the radial direction. With the engaging portion being configured as the groove, the engaged portion may also be configured as a protrusion protruding outward in the radial direction.

In still another mode of the golf club according to one aspect, the plurality of engaged portions maybe disposed at a spacing in a periaxial direction in the outer peripheral surface of the body. The engaged portions may be configured to differentiate axis-directional engagement positions with the engaging portions from each other. The configuration described above enables an adjustment of the axis-directional position of the adaptor with respect to the body by an operation as simple as varying a periaxial direction when attaching and detaching the adaptor to and from the body.

In yet another mode of the golf club according to one aspect, the body may include a first end portion and a second end portion at both ends in the axial direction, the second end portion being formed with an aperture to receive insertion of the shaft. The engaging portions may be configured by protrusions protruding from the inner peripheral surface of the adaptor, and the plurality of engaged portions maybe configured by grooves extending in the axial direction in the outer peripheral surface of the body. The grooves may open on the side of the first end portion and may terminate in different positions on the side of the second end portion. The configuration described above enables the adjustment of the axis-directional position of the adaptor with respect to the body by changing the groove of the body, into which the protrusion of the adaptor is inserted. It is therefore possible to provide the sleeve system capable of adjusting the axis-directional position of the adaptor with respect to the body by a simple operation.

In a further mode of the golf club according to one aspect, the outer peripheral surface of the body may be further formed with a concavity extending in a periaxial direction. The concavity may be a portion via which the grooves communicate with each other in a position closer to the first end portion than terminals of the grooves in the axial direction, and may be enabled to receive insertion of the protrusion of the adaptor. With the configuration described above, a rotating position of the adaptor about the body can be varied by using the concavity. The configuration described above enables the adjustment of the axis-directional position of the adaptor with respect to the body without removing the adaptor completely from the body.

In a still further mode of the golf club according to one aspect, the adaptor may be configured in a cylindrical shape to attach to an outer peripheral surface of the body, and an inner peripheral surface of the adaptor may be formed with a plurality of engaging portions extending in an axial direction. The outer peripheral surface of the body may be formed with an engaged portions with which the plurality of engaging portions of the adaptor engages in the rotation-disabled manner in a periaxial direction. The engaged portion may be selectively engaged with one of the plurality of engaging portions to enable the adaptor to vary the axis-directional position with respect to the body. The adaptor maybe configured not to come off the body in such a direction as to separate from the hosel upon the engagement of the engaged portion of the body with one of the plurality of engaging portions of the adaptor. With the configuration described above, it is feasible to provide the sleeve system having the simple structure enabling the adaptor to detachably attached in the axial direction.

In a yet further mode of the golf club according to one aspect, the plurality of engaging portions may be disposed at a spacing in the periaxial direction on the inner peripheral surface of the adaptor. The plurality of engaging portions may be configured to differentiate the engagement positions in the axial direction with the engaged portions. With the configuration described above, the axis-directional position of the adaptor with respect to the body can be adjusted by the operation as simple as varying the periaxial direction when attaching and detaching the adaptor to and from the body.

In a yet further mode of the golf club according to one aspect, the body may include the first end portion and the second end portion at both ends in the axial direction, and the second end portion may be formed with the aperture to receive insertion of the shaft. The adaptor may include a first end portion and a second end portion at both ends in the axial direction, and the first end portion may engage with an upper end of the hosel. The plurality of engaging portions may be configured by protrusions protruding from the inner peripheral surface of the adaptor, and the protrusions may be formed so as to terminate in different positions on the side of the second end portion in the axial direction. The engaged portion may be configured by groove extending in the axial direction in the outer peripheral surface of the body, and the groove may open on the side of the first end portion and may terminate on the side of the second end portion. The body may further include an auxiliary groove receiving, upon the engagement of one of the protrusions with the groove, insertion of another protrusion. With the configuration described above, the axis-directional position of the adaptor with respect to the body can be adjusted by changing the protrusion of the adaptor, the protrusion being inserted in the groove of the body. It is therefore feasible to provide the sleeve system capable of adjusting the axis-directional position of the adaptor with respect to the body by the simple operation.

DESCRIPTION OF EMBODIMENT

An embodiment (which will hereinafter be referred to also as "the present embodiment") according to one aspect of the present invention will hereinafter be described with reference to the accompanying drawings. However, the present embodiment, which will be discussed below, is merely an exemplification of the present invention in every respect. A variety of improvements and modifications may be made without deviating from the scope of the present invention. In other words, a specific configuration corresponding to the embodiment may be properly adopted upon carrying out the present invention. Note that the description will be made based on directions on planes of the drawings for the convenience of explanation in the following discussion.

§ 1. Whole Structure of Golf Club

Figure 1:
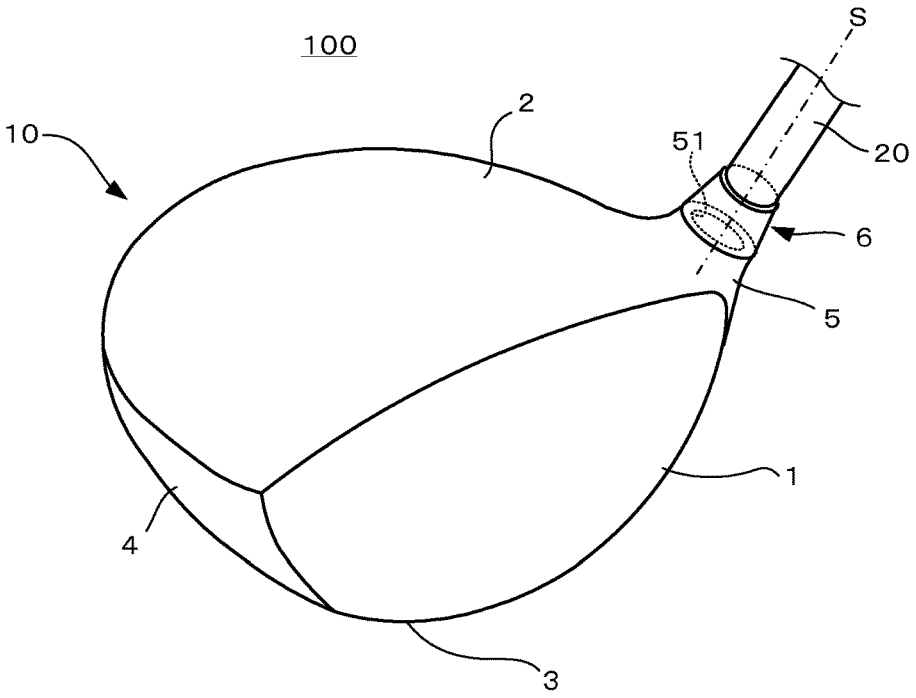
FIG. 1 is a perspective view illustrating a whole structure of a golf club according to an embodiment.
Figure 2:
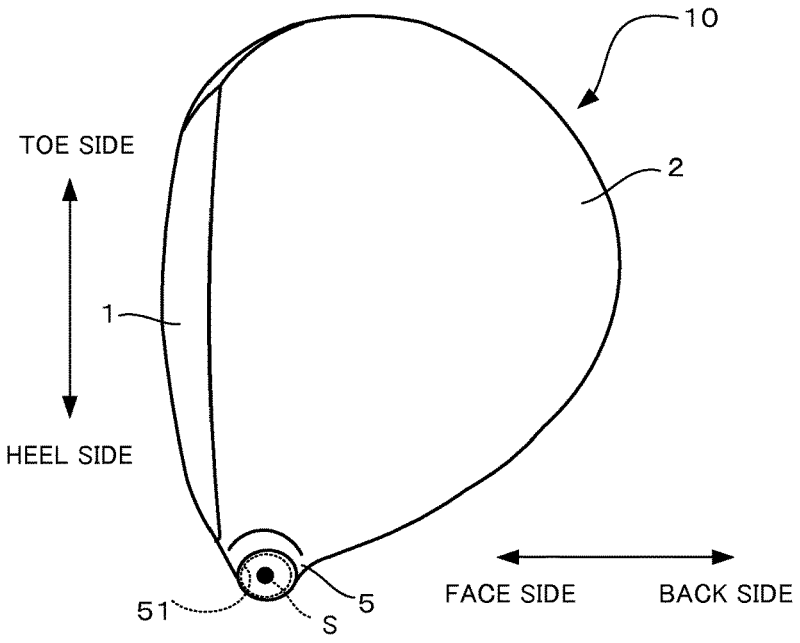
FIG. 2 is a plan view depicting a golf club head according to the embodiment.

At first, a whole structure of a golf club is described with reference to FIGS. 1 and 2. FIG. 1 is a perspective view illustrating a whole structure of a golf club 100 according to the present embodiment. FIG. 2 is a plan view depicting a golf club head 10 according to the present embodiment.

As depicted in FIGS. 1 and 2, the golf club 100 according to the present embodiment includes a shaft 20 and the golf club head 10 (which will hereinafter be also simply termed the "head") joined to an end portion of the shaft 20. The shaft 20 and the golf club head 10 are jointed to together via a sleeve system 6 that will be described later on, thereby providing a configuration enabling a club length to vary. Note that the club length may not be strictly defined if able to indicate a substantial length from a distal end of the shaft 20 on a grip side down to a bottom face of the head 10. The club length can be measured by, e.g., a 60-degrees method (based on a 60-degree lie angle as a standard angle), a heel end method and other equivalent methods specified in the Rules of Golf. The respective members thereof will hereinafter be described.

The shaft 20 is configured to take a hollowed cylindrical shape, and the golf club head 10 is joined to a lower end of the shaft 20. A grip composed of a rubber and other equivalent materials is, though not illustrated, fixed to the upper end of the shaft 20. The materials for the shaft 20 may be properly selected corresponding to the embodiment and may involve using, e.g., CFRP (Carbon Fiber-Glass Reinforced Plastics), steel and other equivalent materials. Note that an extending direction of the shaft 20 corresponds to an "axial direction" according to the present invention. The "axial direction" may not, however, be strictly defined if able to indicate a direction of connecting an upper end and a lower end of every member.

The golf club head 10 has a hollowed structure. An external surface of the golf club head 10 is configured by a face 1, a crown 2, a sole 3, a side 4 and a hosel 5. The face 1 has a face surface to hit a golf ball. The crown 2 is adjacent to the face 1 and configures an upper surface of the head 10. The sole 3 configures a bottom face of the head 10 and is adjacent to the face 1 and the side 4. The side 4 is a portion between the crown 2 and the sole 3. The side 4 is also a portion extending from the side of a toe of the face 1 to the side of a heel of the face 1 via a back side of the head 10.

The hosel 5 is a cylindrical portion provided neighboring to the side of heel of the crown 2, and has a hole 51 for attaching the shaft 20. Specifically, the hole 51 receives insertion of a body 7 of the after-mentioned sleeve system 6 together with the shaft 20, the sleeve system 6 being fixed to the lower end of the shaft 20. An in-depth description of an internal structure of the hosel 5 will hereinafter be made. Note that the head 10 to be explained in the present embodiment is of a wood type instanced by a driver (#1) or a fairway wood, but is not limited to the type thereof. The head 10 may adopt a variety of types instanced by a so-called utility type, a so-called hybrid type, a so-called iron type, a so-called putter type and other equivalent types.

§ 2 Joint Structure between Shaft and Golf Club Head

Figure 3:
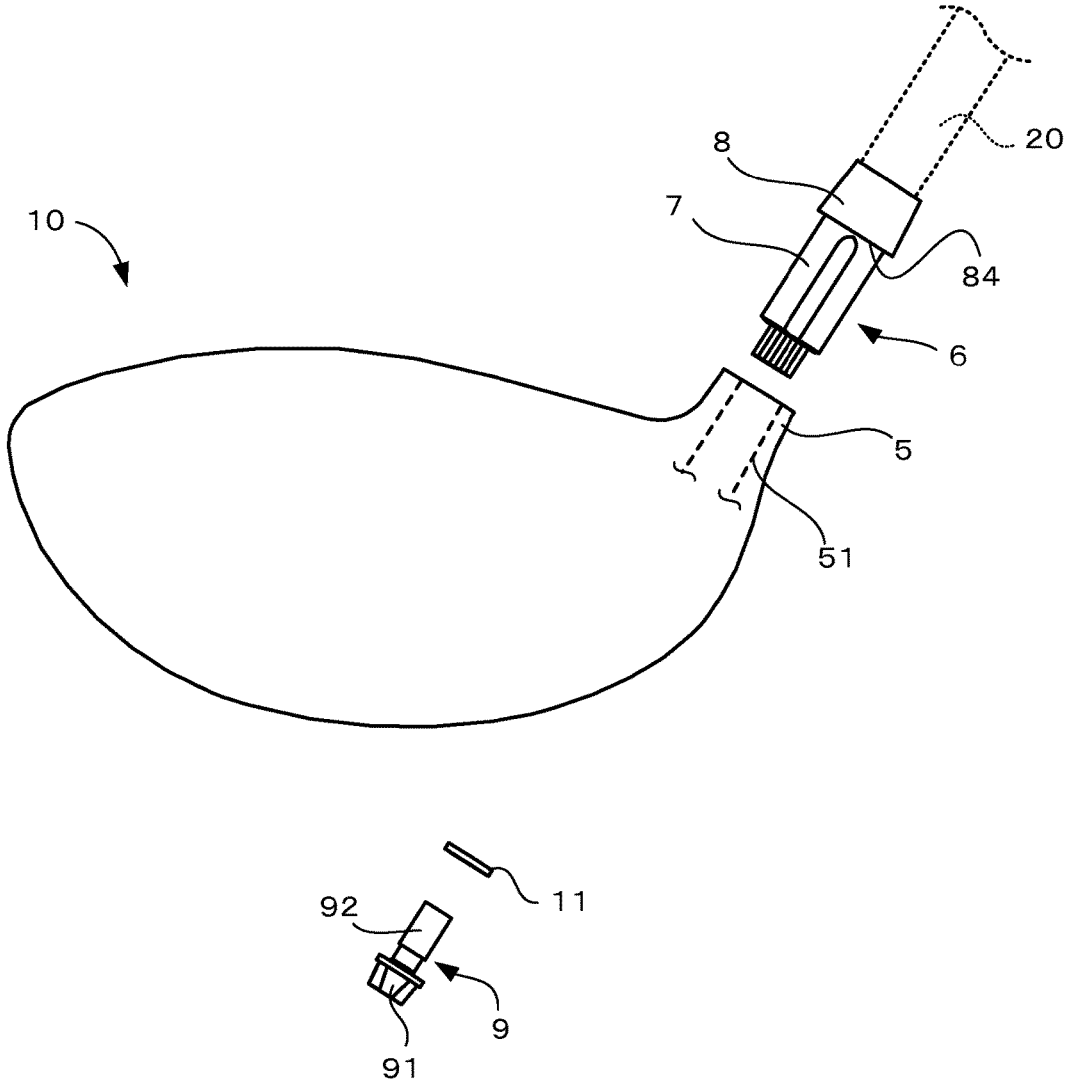
FIG. 3 is an exploded view depicting a structure for joining the golf club head and a shaft together according to the embodiment.

Next, a joint structure between the shaft 20 and the golf club head 10 is described with reference to FIGS. 3 through 8. FIG. 3 is an exploded view illustrating the joint structure between the shaft 20 and the golf club head 10. As illustrated in FIG. 3, the shaft 20 and the golf club head 10 are joined together via the sleeve system 6. The sleeve system 6 includes the body 7 and an adaptor 8. At least a part of the body 7 is fixed in a state of being housed in an internal space of the hosel 5 by a washer 11 and a fixture 9. Components of the joint structure will hereinafter be described.

[Hosel]

Figure 4:
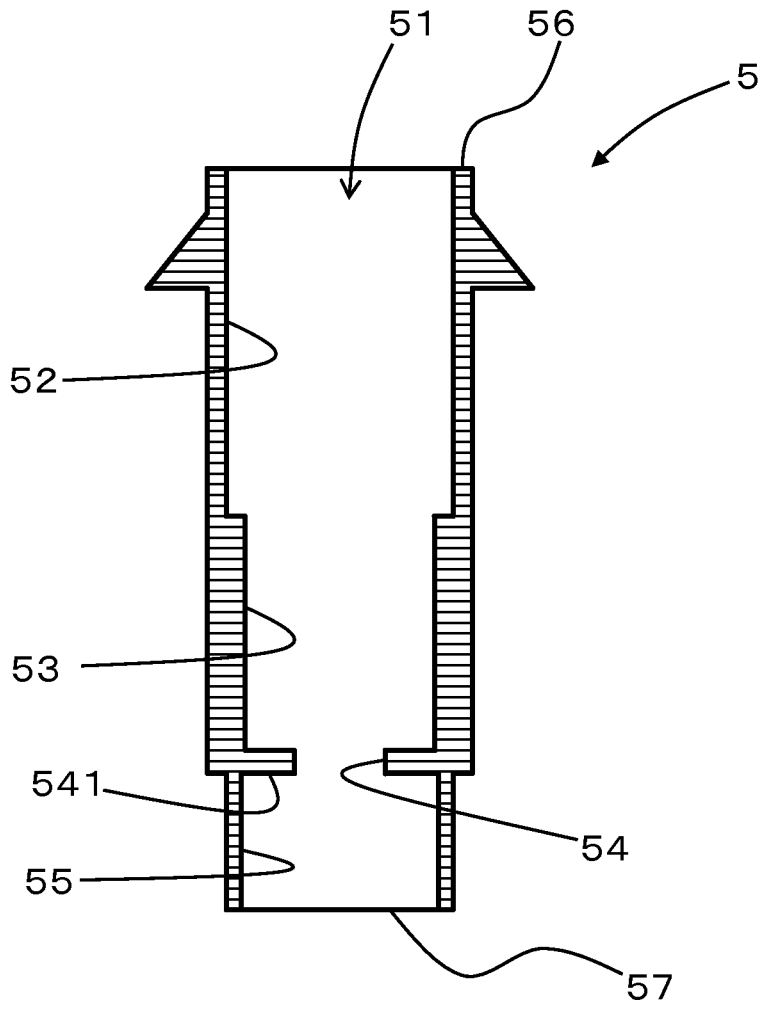
FIG. 4 is a sectional view schematically illustrating an internal space of a hosel according to the embodiment.

The description starts with the internal space of the hosel 5, into which the body 7 of the sleeve system 6 is inserted, with reference to FIG. 4. FIG. 4 is a sectional view schematically illustrating the internal space of the hosel 5. As depicted in FIG. 4, the internal space of the hosel 5 according to the present embodiment is configured by a first diametral portion 52, a second diametral portion 53 and a third diametral portion 55 in the sequence from an upper end 56 down to a lower end 57.

The first diametral portion 52 is formed in a cylindrical shape, and opens at the upper end 56. The second diametral portion 53 is continuous from the first diametral portion 52 and formed in the cylindrical shape being slightly smaller in diameter than the first diametral portion 52. The second diametral portion 53 has an inner peripheral surface formed with a plurality of groove lines (unillustrated) corresponding to a plurality of protrusion lines 721 formed along an outer peripheral surface of a second cylindrical portion 72 of the after-mentioned body 7. In the present embodiment, the first diametral portion 52 and the second diametral portion 53 cooperate to form the hole 51 that opens at the upper end 56. Note that the inner peripheral surface of the second diametral portion 53 may also be formed in a polygonal shape in place of the plurality of groove lines formed as described above. In this case, it may be sufficient that the second cylindrical portion 72 itself is formed in the polygonal shape in section by substituting for the plurality of protrusions 721 formed on the outer peripheral surface of the second cylindrical portion 72 of the after-mentioned body 7.

The third diametral portion 55 taking the cylindrical shape is disposed on the side of the lower end of the second diametral portion 53. A partition wall 541 is provided between the third diametral portion 55 and the second diametral portion 53. The partition wall 541 is formed with a circular aperture 54 being smaller in diameter than the second and third diametral portions 53, 55, the aperture 54 penetrating the interior in a vertical direction. The partition wall 541 is therefore formed in an annular shape. The second diametral portion 53 communicates with the third diametral portion 55 via the aperture 54. Note that the third diametral portion 55 opens at the lower end 57. With this configuration, the internal space of the hosel 5 penetrates down toward the side 4 and the sole 3 of the head 10 substantially in parallel with the axial direction of the shaft 20.

When assembling the golf club 100, the body 7 of t the sleeve system 6 is inserted from the upper end 56 into the first diametral portion 52 and the second diametral portion 53 of the hosel 5. The adaptor 8 is attached to the body 7 and is formed larger in outside diameter than the first diametral portion 52. The body 7 can be thereby inserted downward in the axial direction till a lower end 84 of the adaptor 8 engages with the upper end 56 of the hosel 5. On the other hand, the washer 11 and the screw-shaped fixture 9 are inserted into the third diametral portion 55 from the lower end 57. The fixture 9 is screw-fastened to the body 7. The sleeve system 6 is thereby fixed removably in the axial direction.

Figure 9A:
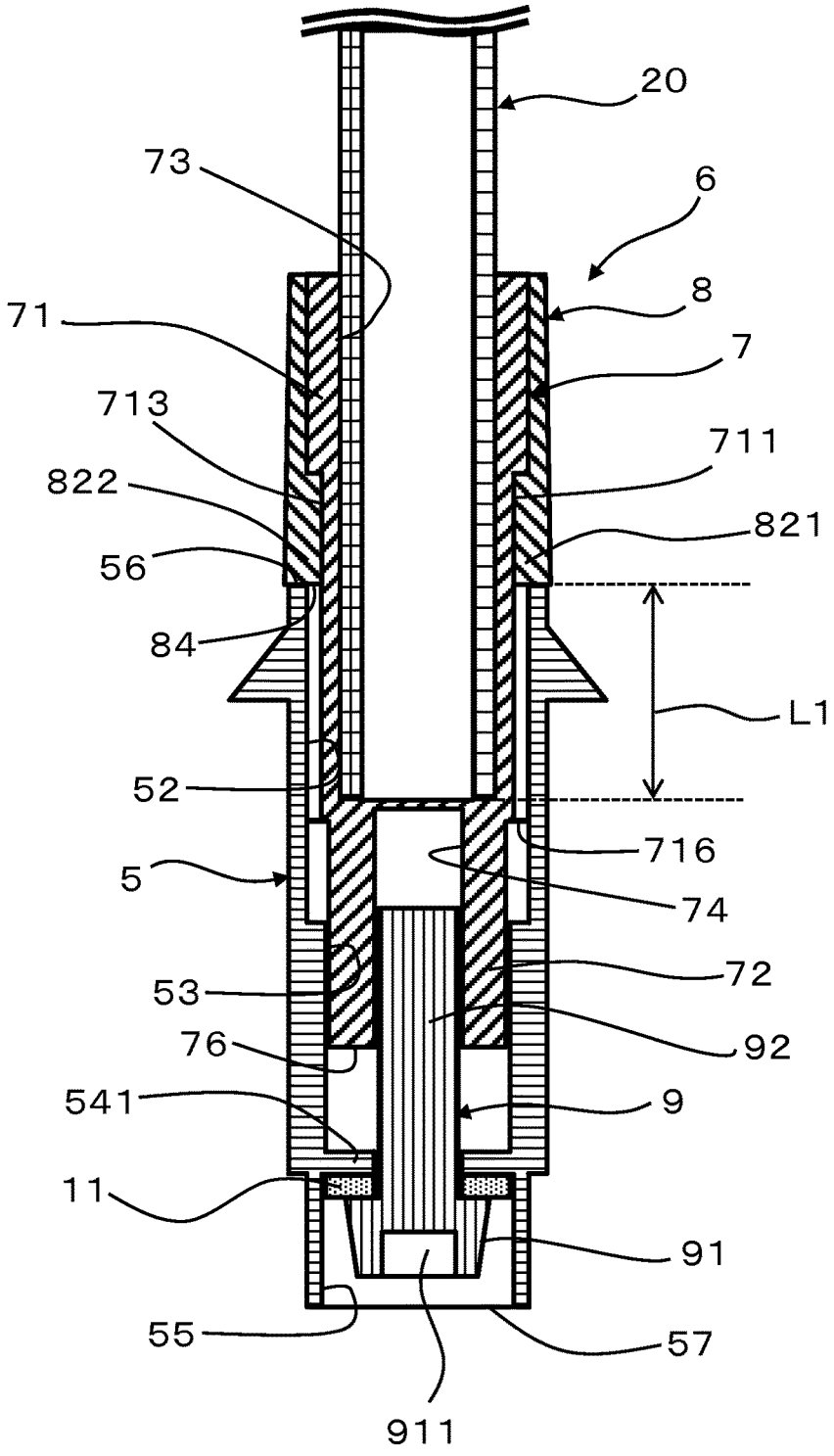
FIG. 9A is a view schematically illustrating a state of joining the sleeve system and the hosel together when attaching the adaptor to the body in a first position.
Figure 9B:
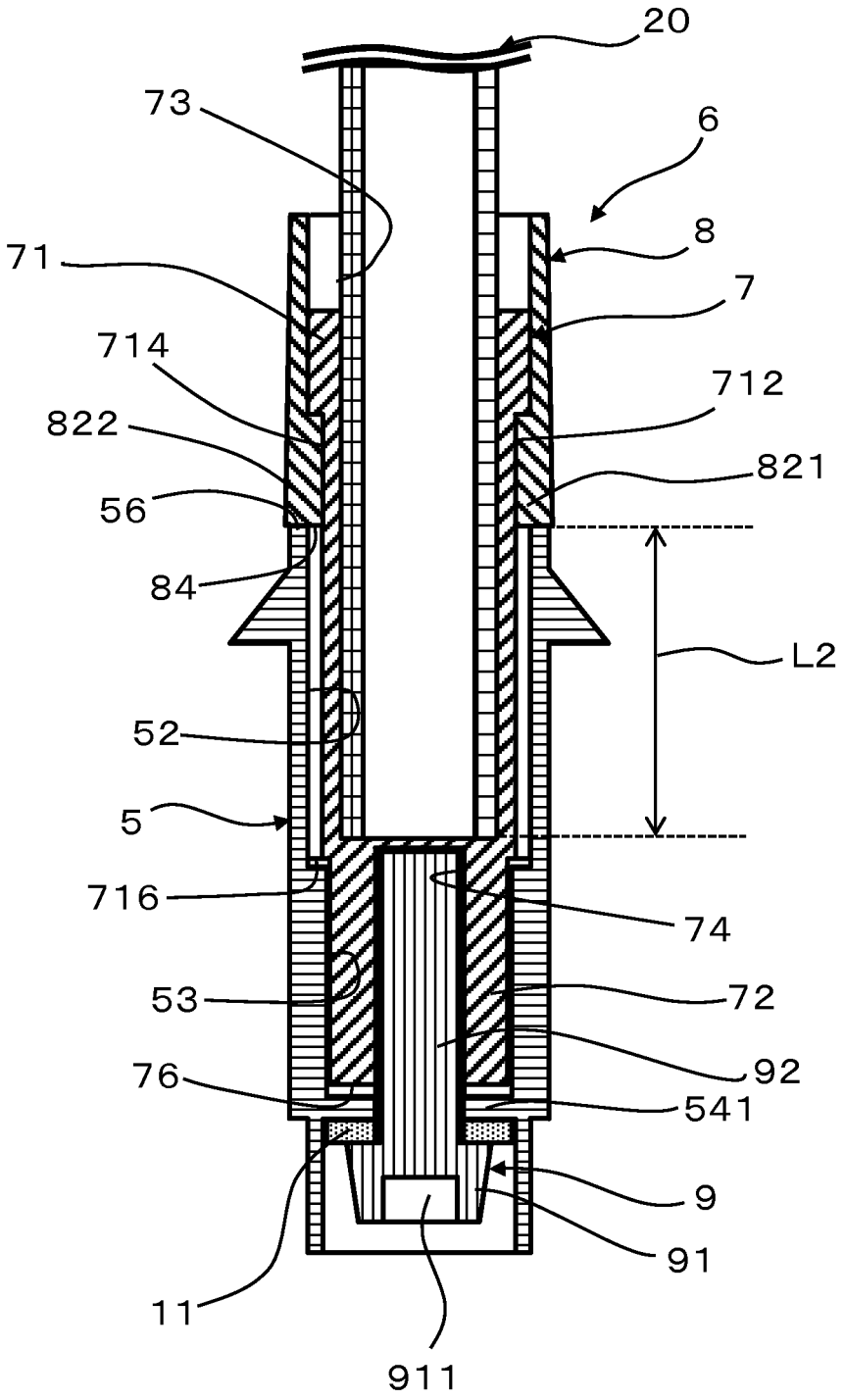
FIG. 9B is a view schematically illustrating a state of joining the sleeve system and the hosel together when attaching the adaptor to the body in a second position.

Note that the fixture 9 is constructed to include a head portion 91 and a screw portion 92 joined to the head portion 91 as depicted in FIG. 3. The screw portion 92 is formed smaller in diameter than a diameter of the aperture 54 so that the screw portion 92 can be inserted into the aperture 54 to reach the second diametral portion 53 from the lower end 57. By contrast, the head portion 91 is formed larger in diameter that the diameter of the aperture 54 so that the overall fixture 9 does not pass through the aperture 54. As depicted in FIGS. 9A and 9B that will be given later on, the head portion 91 is formed with a rectangular recessed portion 911 receiving insertion of a wrench. A user is consequently enabled to fasten or unfasten the sleeve system 6 by operating the wrench being attached in the recessed portion 911.

[Sleeve System]

(Body)

Figure 5A:
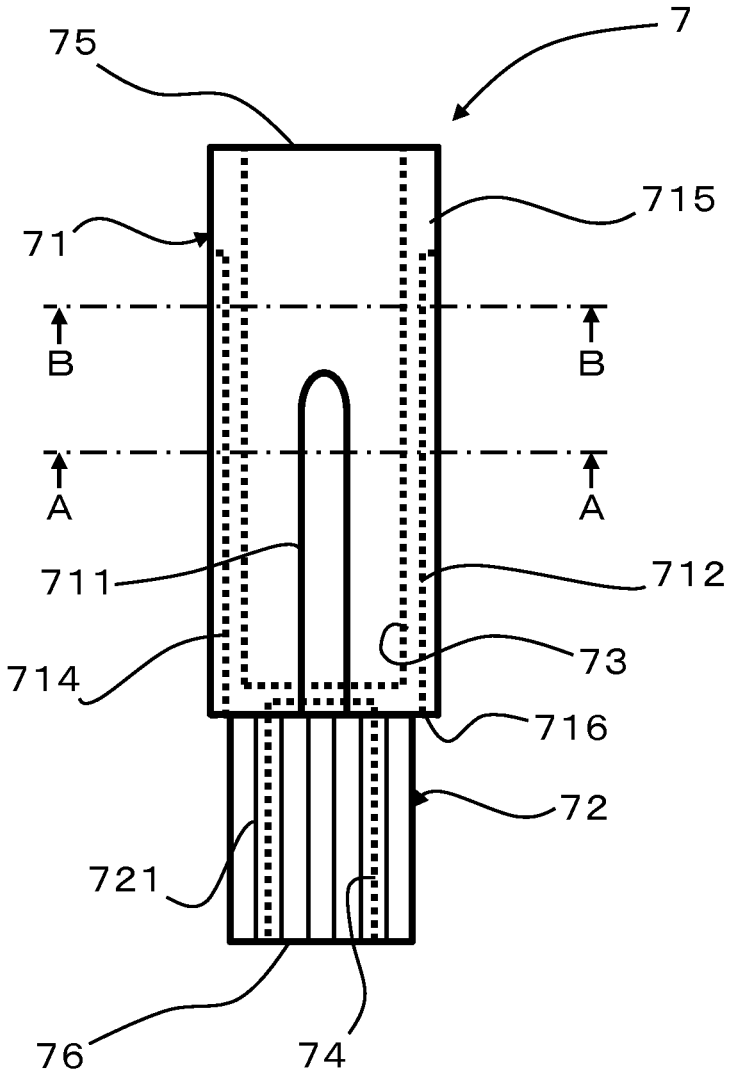
FIG. 5A is a front view schematically illustrating a body of a sleeve system according to the embodiment.
Figure 5B:
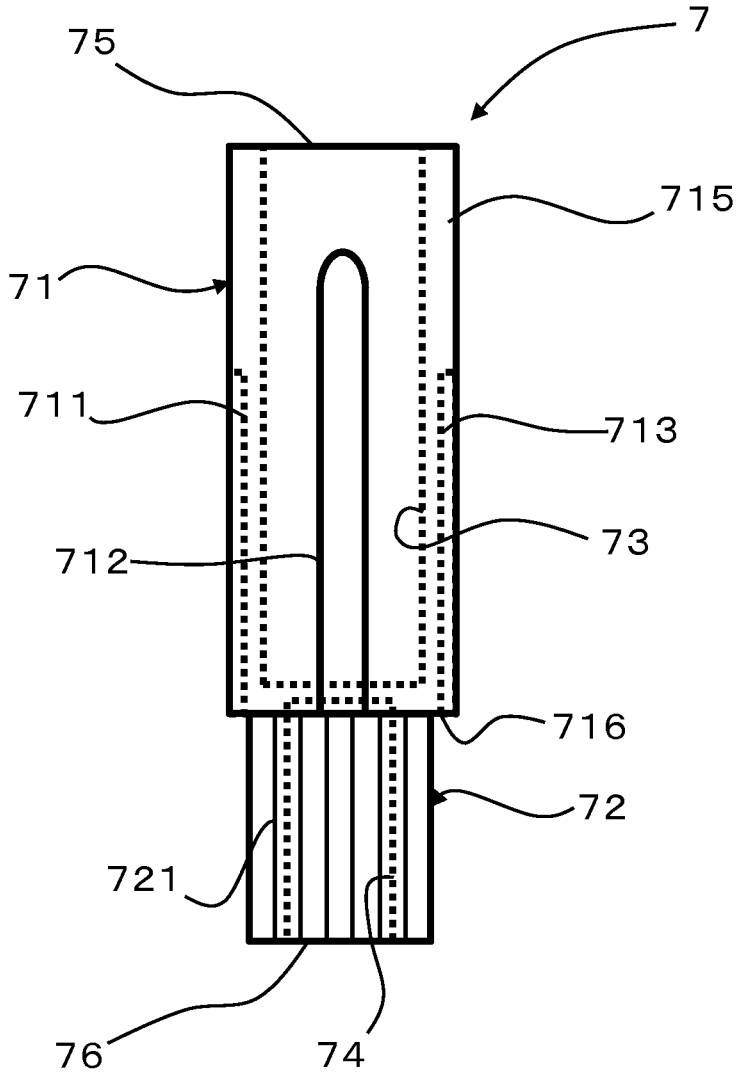
FIG. 5B is a side view schematically illustrating the body of the sleeve system according to the embodiment.
Figure 6A:
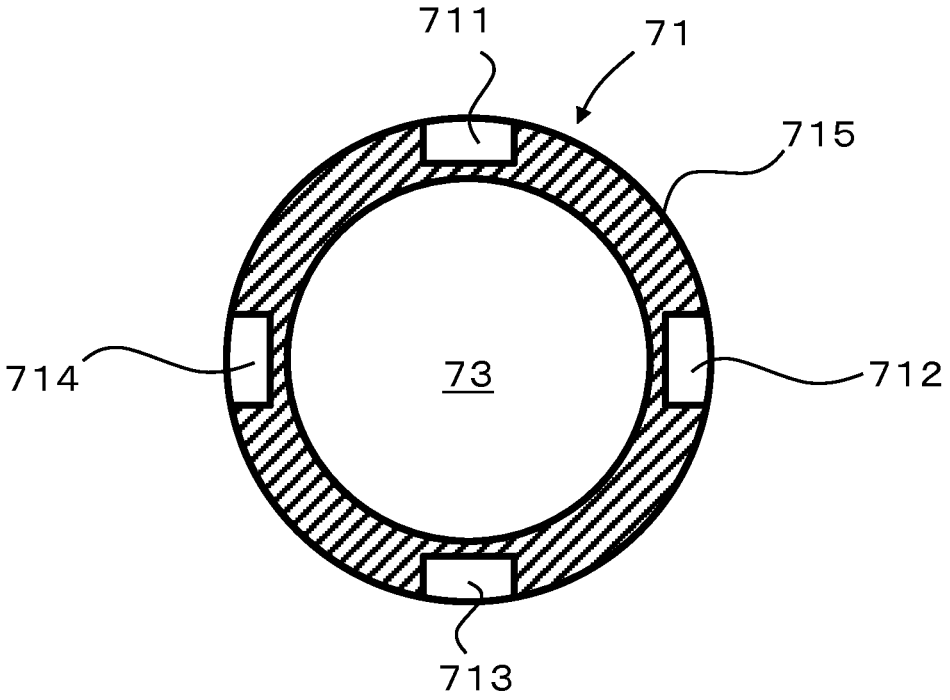
FIG. 6A is a sectional view taken along the line A-A in FIG. 5A.
Figure 6B:
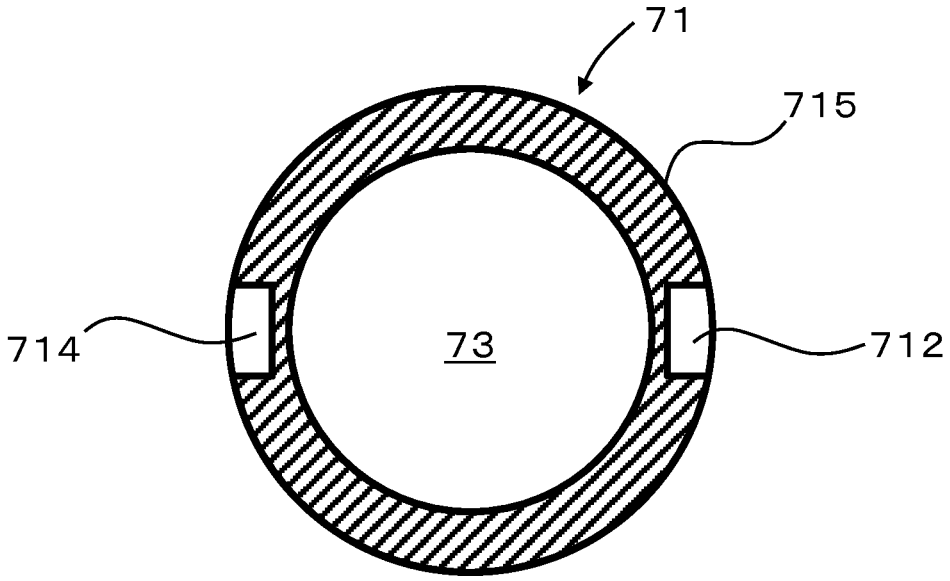
FIG. 6B is a sectional view taken along the line B-B in FIG. 5A.

Next, the body 7 of the sleeve system 6 according to the present embodiment is described with reference to FIGS. 5A, 5B, 6A and 6B. FIG. 5A is a front view schematically illustrating the body 7 according to the present embodiment. FIG. 5B is a side view schematically illustrating the body 7 according to the present embodiment. FIG. 6A illustrates a section taken along the line A-A in FIG. 5A. FIG. 6B depicts a section taken along the line B-B in FIG. 5A.

As illustrated in FIGS. 5A and 5B, the body 7 according to the present embodiment includes two ends, i.e., an upper end 75 and a lower end 76 in the axial direction (the vertical direction as viewed in the drawings). The upper end 75 corresponds to "a second end portion of the body portion" according to the present invention. The lower end 76 corresponds to "a first end portion of the body portion" according to the present invention. The body 7 according to the present embodiment includes a first cylindrical portion 71 and a second cylindrical portion 72 being smaller in diameter than the first cylindrical portion 71 in the sequence from the upper end 75.

The first cylindrical portion 71 is inserted into the first diametral portion 52 of the hosel 5. The first cylindrical portion 71 is larger in outside diameter than the second diametral portion 53, in inside diameter, of the hosel 5 and is configured to be insertable into the first diametral portion 52 of the hosel 5. If not taking the after-mentioned adaptor 8 into consideration, the body 7 can be therefore inserted into the internal space of the hosel 5 till a lower end face 716 of the first cylindrical portion 71 abuts on a stepped portion formed between the first diametral portion 52 and the second diametral portion 53.

The first cylindrical portion 71 has an outer peripheral surface 715 formed with four grooves 711-714 recessed inward in a radial direction and extending in the axial direction. The four grooves 711-714, which are disposed in a periaxial direction (in a peripheral direction) at an equal interval, extend upward from the lower end of the first cylindrical portion 71 in the axial direction and terminate on the side of the upper end 75. A terminal portion of each of the grooves 711-714 takes a shape being bent upward. The terminal portion of each of the grooves 711-714 may not take the upward bent shape but may be formed in a rectangular shape other than this bent shape. Note that the following discussion will designate the four grooves 711-714 as first through fourth grooves 711-714 for the convenience of explanation.

The first cylindrical portion 71 is herein formed larger in diameter than the second cylindrical portion 72. The first cylindrical portion 71 has its lower end formed with a stepped portion corresponding to a difference in diameter between the first cylindrical portion 71 and the second cylindrical portion 72. A lower end of each of the grooves 711-714 extends to this stepped portion (the end face 716). The grooves 711-714 therefore open on the side of the lower end 76.

As illustrated in FIGS. 5A and 5B, in the four grooves 711-714 formed in the outer peripheral surface 715 of the first cylindrical portion 71, the first groove 711 and the third groove 713 are disposed opposite with each other and terminate in the same position on the side of the upper end 75. Similarly, the second groove 712 and the fourth groove 714 are disposed opposite with each other and terminate in the same position on the side of the upper end 75.

However, the terminating position of the second groove 712 and the fourth groove 714 is different from the terminating position of the first groove 711 and the third groove 713. To be specific, the second groove 712 and the fourth groove 714 terminate in the position closer to the upper end 75 than the first groove 711 and the third groove 713. Therefore, when comparing the section (FIG. 6A) taken along the line A-A in FIG. 5A with the section (FIG. 6B) taken along the line B-B closer to the upper end 75 than the line A-A, the second groove 712 and the fourth groove 714 appear on both of FIGS. 6A and 6B, while the first groove 711 and the third groove 713 appear in only FIG. 6A.

A couple of grooves (711, 713) and another couple of grooves (712, 714) being disposed opposite with each other, correspond to "engaged portions" according to the present invention. The grooves 711-714 correspond to "grooves" according to the present invention. Accordingly, the present embodiment exemplifies an instance of providing the plurality of engaged portions terminating in the different positions on the side of the upper end 75.

The second cylindrical portion 72 is inserted into the second diametral portion 53 of the hosel 5. The second cylindrical portion 72 is therefore formed smaller in outside diameter than the first cylindrical portion 71 to be insertable into the second diametral portion 53 of the hosel 5. The second cylindrical portion 72 has its outer peripheral surface formed with a plurality of protruded lines 721 extending in the axial direction. The plurality of protruded lines 721 corresponds to groove lines formed in the inner peripheral surface of the second diametral portion 53 of the hosel 5. Consequently, when the body 7 is inserted in the axial direction into the hole 51 of the hosel 5, the plurality of protruded lines 721 formed on the second cylindrical portion 72 of the body 7 engages with the plurality of groove lines formed in the second diametral portion 53 of the hosel 5. The body 7 and the hosel 5 are thereby joined together so as to be rotation-disabled in the periaxial direction. Note that the phrase "being joined" or "joining" connotes herein at least "the two members being secured not to be movable" but is not requested "to prevent the two members from being separated even by receiving an external force applied". The same definition is applied to the phrase "being joined" or "joining" to be used as below.

The body 7 has an external shape extending in the vertical direction. The body 7 includes a use-for-shaft recessed portion 73 opening on the side of the upper end 75 in an area substantially covering existence of the first cylindrical portion 71. The use-for-shaft recessed portion 73 has a cylindrical inner peripheral surface extending in the vertical direction and receives insertion of the lower end of the shaft 20. The shaft 20 is fixed to the use-for-shaft recessed portion 73 by a fixing means instanced by a bonding agent and other equivalent agents. An axial center S (see FIG. 1) of the shaft 20 is thereby fixed so as to extend in an extending direction (the vertical direction in FIGS. 5A and 5B) of the use-for-shaft recessed portion 73. Note that the bonding agent for fixing the shaft 20 may be, without being limited to a particular agent, properly selected corresponding to the embodiment.

The body 7 further has a use-for-fixture recessed portion 74 opening on the side of the lower end 76 in an area substantially covering existence of the second cylindrical portion 72. An inside diameter of the use-for-fixture recessed portion 74 corresponds to an outside diameter of the screw portion 92 of the fixture 9. The use-for-fixture recessed portion 74 has its inner peripheral surface formed with a female thread (unillustrated) to which a male thread (unillustrated) formed on an outer peripheral surface of the screw portion 92 is screwed. Consequently, after inserting the body 7 into the hole 51 of the hosel 5, the fixture 9 is inserted into the internal space from the lower end 57 of the hosel 5, and the screw portion 92 of the fixture 9 is screwed to the use-for-fixture recessed portion 74 of the body 7, thereby enabling the fixture 9 and the body 7 to be screw-fastened together.

(Adaptor 8)

Figure 7:
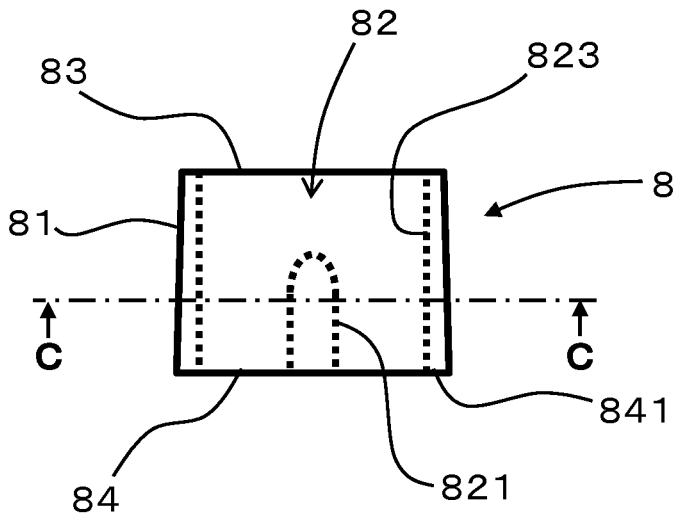
FIG. 7 is a front view schematically illustrating an adaptor of the sleeve system according to the embodiment.
Figure 8:
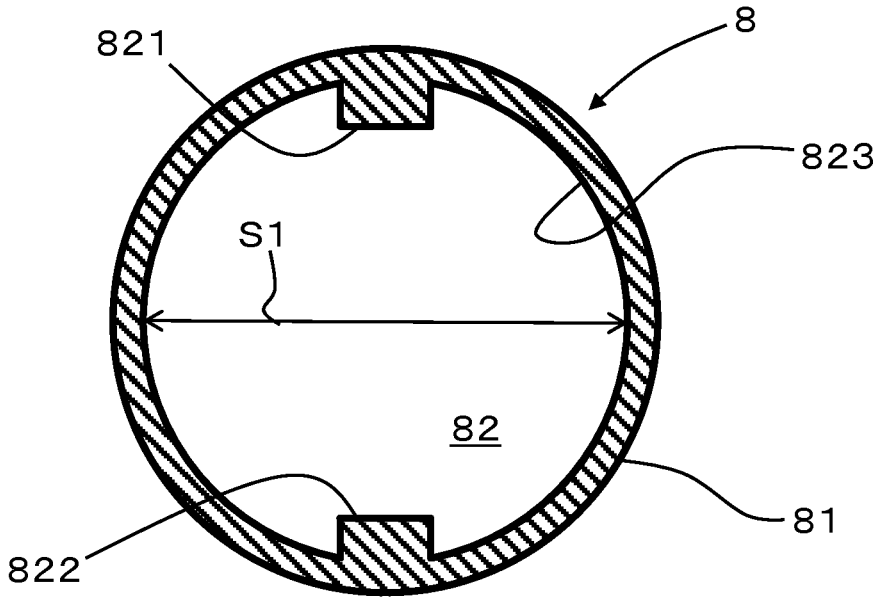
FIG. 8 is a sectional view taken along the line C-C in FIG. 7.

Next, the adaptor 8 of the sleeve system 6 according to the present embodiment is described with reference to FIGS. 7 and 8. FIG. 7 is a front view schematically illustrating the adaptor 8 according to the present embodiment. FIG. 8 depicts a section taken along the line C-C in FIG. 7

As depicted in FIG. 7, the adaptor 8 according to the present embodiment is cylindrically formed to be attached on the outer peripheral surface 715 of the body 7. The adaptor 8 includes an upper end 83 and a lower end 84. The upper end 83 corresponds to "a second end portion of an adaptor portion" according to the present invention. The lower end 84 corresponds to "a first end portion of the adaptor portion" according to the present invention.

The adaptor 8 opens at both of the upper end 83 and the lower end 84. The adaptor 8 includes a through-hole 82 penetrating in the vertical direction. The adaptor has the outer peripheral surface 81 being tapered so that the outside diameter thereof gradually expands toward the lower end 84. The outer peripheral surface 81 of the adaptor 8 at the lower end is formed to have a larger outside diameter than the inside diameter of the first diametral portion 52. With this configuration, the lower end 84 of the adaptor 8 is not attached in the first diametral portion 52 of the hosel 5 but engages with the upper end 56 of the hosel 5. On the other hand, the adaptor 8 includes an inner peripheral surface 823 having an inside diameter (S1 in FIG. 8) that is uniformed corresponding to the outside diameter of the first cylindrical portion 71 of the body 7.

As depicted in FIGS. 7 and 8, the inner peripheral surface 823 of the adaptor 8 is provided with a couple of protrusions (821, 822) protruding inward in the radial direction. The couple of protrusions (821, 822) corresponds to "engaging portion" according to the present invention. The protrusions (821, 822) are disposed opposite with each other. The protrusions (821, 822) are configured to extend upward from the lower end 84 and terminate in the same position on the side of the upper end 83. Terminal portions of the protrusions (821, 822) take shapes being bent upward corresponding to the terminal portions of the grooves 711-714 formed in the body 7. Note that the following discussion designates these two protrusions also as a first protrusion 821 and a second protrusion 822 for the convenience of explanation.

The protrusions (821, 822) have heights (length in the radial direction) corresponding to depths (lengths in the radial direction) of the grooves 711-714 formed in the body 7. In other words, the protrusions (821, 822) are configured to have substantially the same heights as the depths of the grooves 711-714 formed in the body 7. The inside diameter S1 of the inner peripheral surface 823 exclusive of the protrusions (821, 822) is substantially equivalent to the outside diameter of the first cylindrical portion 71 of the body 7.

Therefore, according to the present embodiment, the attaching of the adaptor 8 to the body 7 from the upper end 75 causes the lower end of each of the protrusions (821, 822) of the adaptor 8 to abut on the end face on the side of the upper end 75 of the body 7. Consequently, the adaptor 8 is disabled from being attached in the first cylindrical portion 71 in the axial direction even by trying to attach the adaptor 8 to the body 7 from the upper end 75. Thus, the adaptor 8 cannot be mounted onto the body 7.

By contrast, the attaching of the adaptor 8 to the body 7 from the lower end 76 enables the protrusions (821, 822) to move in the axial direction along the couple of grooves (711, 713) in such a rotating position that the two protrusions (821, 822) engage with the couple of grooves (711, 713). Specifically, the protrusions (821, 822) remain movable till the terminals (upper ends) of the protrusions (821, 822) abut on the terminals (upper ends) of the grooves (711, 713), but are unmovable any more upward in the axial direction. The adaptor 8 can be therefore attached in the first cylindrical portion 71 in the axial direction till the terminals of the protrusions (821, 822) abut on the terminals of the grooves (711, 713).

Specifically, on the occasion of attaching the adaptor 8 to the body 7 from the lower end 76, the adaptor 8 is attached to the body 7 by being moved toward the upper end 75, in other words, in such a direction as to separate away from the hosel 5 without coming off the body 7 in a position where the terminals of the protrusions (821, 822) abut on the terminals of the grooves (711, 713). The same is applied to the rotating position where the two protrusions (821, 822) engage with the couple of grooves (712, 714). Namely, the adaptor 8 can be attached in the first cylindrical portion 71 in the axial direction till the terminals of the protrusions (821, 822) abut on the terminals of the grooves (712, 714).

Note that the following discussion describes, for the convenience of explanation, the rotating position where the two protrusions (821, 822) engage with the couple of grooves (711, 713) also as "a first position", and describes the rotating position where the two protrusions (821, 822) engage with the couple of grooves (712, 714) also as "a second position". The following discussion further describes an axis-directional position where the adaptor 8 engages with the body 7 upon the abutting of the terminals of the protrusions (821, 822) on the terminals of the grooves (711, 713) as "a first engagement position". The following discussion still further describes an axis-directional position where the adaptor 8 engages with the body 7 upon the abutting of the terminals of the protrusions (821, 822) on the terminals of the grooves (712, 714) as "a second engagement position".

The terminating position of the first groove 711 and the third groove 713 is different from the terminating position of the second groove 712 and the fourth groove 714. The first engagement position between the adaptor 8 and the body 7 in the first position is therefore different from the second engagement position between the adaptor 8 and the body 7 in the second position. The present embodiment enables a variation of the axis-directional engagement position where the adaptor 8 engages with the body 7 by varying the rotating position of the adaptor 8, in other words, varying the attaching direction of the adaptor 8 to the body 7. In other words, the present embodiment enables the variation of the axis-directional position of the adaptor 8 with respect to the body 7 by causing the two protrusions (821, 822) to selectively engage with the couple of grooves in the two couples of grooves.

The second groove 712 and the fourth groove 714 terminate in the position closer to the upper end 75 than the first groove 711 and the third groove 713. The second engagement position is therefore more upward than the first engagement position, and the adaptor 8 can be fastened to the body 7 closer to the upper end 75 in the axial direction by attaching the adaptor 8 to the body 7 in the second position than by attaching the adaptor 8 to the body 7 in the first position.

Note that the adaptor 8 is attached to the body 7 in each position, in which case the protrusions (821, 822) engage with any of the four grooves 711-714, with the result that the adaptor 8 is joined to the body 7 so as to be rotation-disabled in the periaxial direction. When trying to attach the adaptor 8 to the body 7 in a position other than those positions, the upper ends (the terminal portions on the side of the upper end 83) of the protrusions (821, 822) of the adaptor 8 abut on the end face 716 in the same way as in the case of attaching the adaptor 8 from the upper end 75. A part of the upper end 83 not formed with the protrusions (821, 822) can be attached in the first cylindrical portion 71. However, the portion formed with the protrusions (821, 822) is not inserted through the first cylindrical portion 71 to disable the adaptor 8 from attaching to the body 7.

With the adaptor 8 being attached to the body 7 in the first position, the first protrusion 821 may engage with the first groove 711, and the second protrusion 822 may engage with the third groove 713. Alternatively, the first protrusion 821 may engage with the third groove 713, and the second protrusion 822 may engage with the first groove 711. The two protrusions (821, 822) and the two grooves (711, 713) are disposed in symmetry, and hence there is no difference therebetween. The same is applied to a case of attaching the adaptor 8 to the body 7 in the second position.

Note that materials of the body 7 and the adaptor 8 building up the sleeve system 6 may be properly selected corresponding to the embodiment, and the materials instanced by Ti (6-4Ti), Al (Al5052, Al7075) and other equivalent materials may also be used.

§ 3 Assembly of Shaft and Golf Club Head

Next, an assembly method of the golf club 100 configured as described above is described with reference to FIGS. 9A and 9B. Given specifically is a description of a method of attaching the shaft 20 to the golf club head 10. FIGS. 9A and 9B schematically illustrate joined states of the sleeve system 6 and the hosel 5 when the adaptor 8 is attached to the body 7 in the first and second positions.

The user at first selects any one of the first position and the second position, and attaches the adaptor 8 to the body 7 from the lower end 76 of the body 7 mounted to the tip of the shaft 20. Upon this operation, the protrusions (821, 822) engage with any of four grooves 711-714, resulting in a connection between the body 7 and the adaptor 8 in a rotation-disabled state.

Subsequently, the user inserts the body 7 attached with the adaptor 8 into the hole 51 of the hosel 5. Even when attaching the adaptor 8 in any position, as illustrated in FIGS. 9A and 9B, the body 7 attached with the adaptor 8 can be inserted into the hole 51 of the hosel 5 till the lower end 84 of the adaptor 8 engages with the upper end 56 of the hosel 5.

Herein, as depicted in FIG. 9A, the configuration according to the present embodiment is that the second cylindrical portion 72 of the body 7 reaches the second diametral portion 53 of the hosel 5 even when selecting the first position in which to substantially decrease an axis-directional length from the lower end 84 of the adaptor 8 to the lower end 76 of the body 7. Therefore, even with the first position being selected, the body 7 can be joined to the hosel 5 in the rotation-disabled state in the periaxial direction by causing the plurality of protrusion lines 721 formed on the second cylindrical portion 72 of the body 7 to engage with the plurality of groove lines formed in the second diametral portion 53 of the hosel 5.

Additionally, as depicted in FIG. 9B, the configuration according to the present embodiment is that, even when selecting the second position in which to substantially increase the axis-directional length from the lower end 84 of the adaptor 8 to the lower end 76 of the body 7, in other words, even when the lower end (the lower end 76) of the second cylindrical portion 72 of the body 7 becomes closest to the lower end of the second diametral portion 53 of the hosel 5, a slight gap is formed between the lower end of the second cylindrical portion 72 of the body 7 and the lower end of the second diametral portion 53 of the hosel 5. This configuration may reduce a possibility of occurrence of a deficiency caused by a dimensional error and other equivalent errors. Note that one instance of the deficiency due to the dimensional error and other equivalent errors may be given such that the lower end of the second cylindrical portion 72 will have reached the lower end of the second diametral portion 53 before inserting the body 7 completely into the internal space of the hosel 5, resulting in the gap being formed between the lower end 84 of the adaptor 8 and the upper end 56 of the hosel 5. This deficiency might be caused by an excess of the length between the lower end 84 of the adaptor 8 and the lower end 76 of the body 7 over the axis-directional length (the length in the vertical direction in the drawings) between the first diametral portion 52 and the second diametral portion 53 of the hosel 5.

Finally, the sleeve system 6 is screw-fastened by inserting the fixture 9 together with the washer 11 in to the internal space of the hosel 5 from the lower end 57 of the hosel 5. The configuration according to the present embodiment is that, as depicted in FIG. 9A, even with the selection of the first position in which the gap occurs between the lower end 76 of the body 7 and the partition wall 541, the screw portion 92 of the fixture 9 can be inserted into the use-for-fixture recessed portion 74. The body 7 can be therefore screw-fastened by screwing the male thread of the screw portion 92 of the fixture 9 to the female thread of the use-for-fixture recessed portion 74 through the insertion of the fixture 9 from the lower end 57 of the hosel 5. With this operation, the sleeve system 6 is secured in the axial direction by the adaptor 8 and the fixture 9, with the result that the shaft 20 is mounted to the golf club head 10.

The present embodiment enables an adjustment of the engagement position of the adaptor 8 in the axial direction and determines a position for securing the shaft 20 upon the engagement between the lower end 84 of the adaptor 8 and the upper end 56 of the hosel 5. In other words, the present embodiment eliminates a necessity for providing the system for securing the shaft 20 to the internal peripheral surface of the hosel 5. According to the present embodiment, a diameter of a neck, i.e., the inside diameter of the internal space of the hosel 5 can be therefore prevented from increasing.

As illustrated in FIGS. 9A and 9B, an insertion depth L1 of the shaft 20 with the selection of the first position is shorter by a dimension for attaching the adaptor 8 to the body 7 downward in the axial direction than an insertion depth L2 of the shaft 20 with the selection of the second position. Consequently, the selection of the first position leads to a decreased depth of the insertion of the shaft 20 into the hosel 5 and leads to an increased club length. By contrast, the selection of the second position leads to an increased depth of the insertion of the shaft 20 into the hosel 5 and leads to a decreased club length. Hence, the user can adjust the club length to attain a desired length by selecting the rotating position for attaching the adaptor 8 to the body 7. Note that the present embodiment enables the club length to be adjusted to two lengths corresponding to the first position and the second position.

According to the present embodiment, it is feasible to achieve the system for adjusting the club length with the simple components, i.e., the four grooves 711-714 provided in the body 7 and the two protrusions (821, 822) provided on the adaptor 8. The golf club 100 capable of varying the club length can be therefore attained with the simple configuration.

In the present embodiment, the operation of adjusting the club length is a mere operation of varying the direction for attaching the adaptor 8 to the body 7. The present embodiment consequently enables the adjustment of the club length by the simple operation.

One aspect of the present embodiment aims at providing the golf club configured to make variable the club length with the simple structure not to increase the diameter of the neck. As described above, the present embodiment can provide the golf club configured to make variable the club length with the simple structure not to increase the diameter of the neck.

§ 4 Modified Example

The embodiment of the present invention has been discussed above, and the description made so far is a mere exemplification of the present invention in every respect. It is a matter of course that the invention can be improved and modified in a variety of forms without deviating from the scope of the present invention. For example, the components of the golf club 100 may be properly omitted, replaced and added in accordance with the embodiment. The shapes and the sizes of the components of the golf club 100 may also be properly set in accordance with the embodiment. For instance, the following modifications are available. Note that the same reference numerals and symbols as those assigned to the components in the embodiment discussed above, are used to designate the components of the modified example that will be described below for the convenience of explanation.

<4.1>

In the present embodiment, the body 7 is formed with the four grooves 711-714. However, the number of the grooves to be formed in the body 7 may, without being limited to "4", be properly selected corresponding to the embodiment. In other words, the number of the engaged portions to be formed in the body 7 may be, without being limited to "2", equal to or larger than "3".

<4.2>

The couple of grooves (711, 713) and another couple of grooves (712, 714) according to the present embodiment correspond to the "engaged portions" according to the present invention. The present embodiment provides the two grooves to configure the "engaged portion". However, the number of the grooves to configure the "engaged portion" according to the present invention may be, without being limited to "2", properly selected corresponding to the embodiment. For example, the number of the grooves to configure the "engaged portion" may be "1" and may also be equal to or larger than "3". Note that the number of the protrusions to configure the "engaging portion" according to the present invention in this case may be the same as or equal to or smaller than the number of the grooves to configure the "engaged portion".

<4.3>

The grooves 711-714 of the body 7 are disposed at the equal interval in the embodiment. However, with the grooves 711-714 being disposed at spacings, the disposition of the grooves 711-714 may be properly determined corresponding to the embodiment, and the grooves 711-714 may not be disposed at the equal interval. It is to be noted in this case that the protrusions (821, 822) of the adaptor 8 are disposed to enable the engagement with the couple of grooves (711, 713) and another couple of grooves (712, 714) disposed opposite with each other.

<4.4>

The embodiment described above provides the configuration enabling the adjustment of the axis-directional position of the adaptor 8 with respect to the body 7 by forming, e.g., the plurality of engaged portions of the body 7. However, a method for providing the configuration enabling the adjustment of the axis-directional position of the adaptor 8 with respect to the body 7 may be, without being limited to the example given above, properly selected corresponding to the embodiment. For example, the embodiment may provide a configuration enabling the adjustment of the axis-directional position of the adaptor 8 with respect to the body by forming, as illustrated in FIGS. 10A-13B, the plurality of engaging portions of the adaptor 8.

Figure 10A:
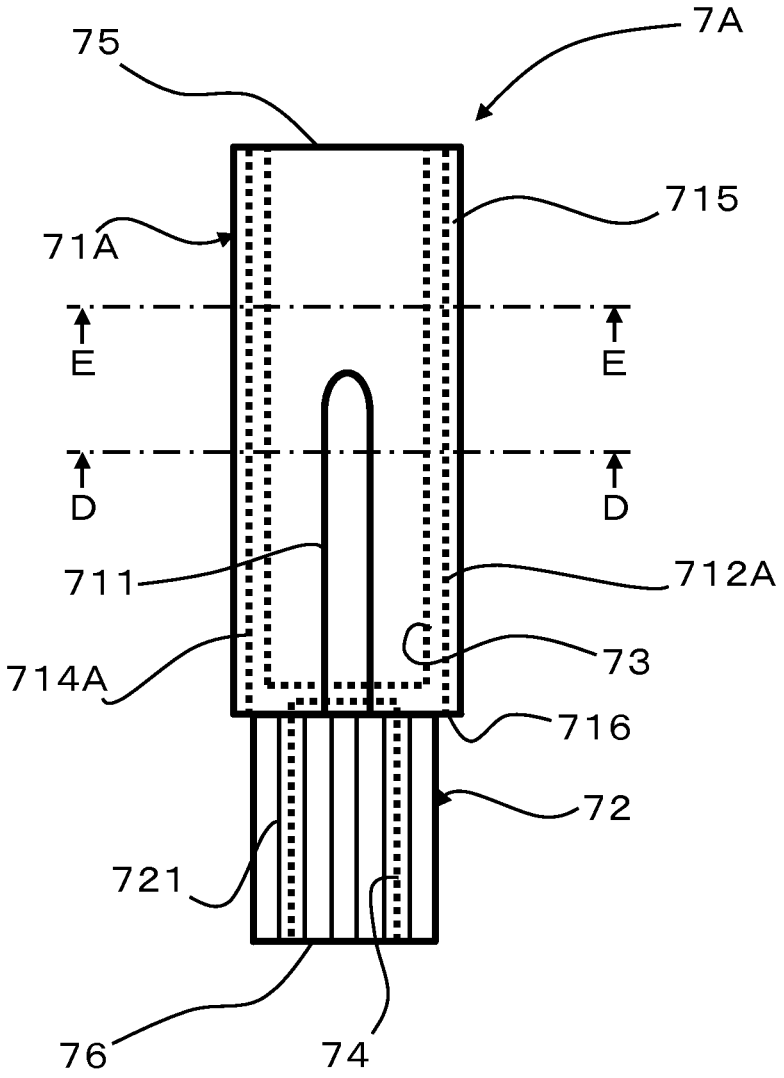
FIG. 10A is a front view schematically illustrating the body of the sleeve system in another mode.
Figure 10B:
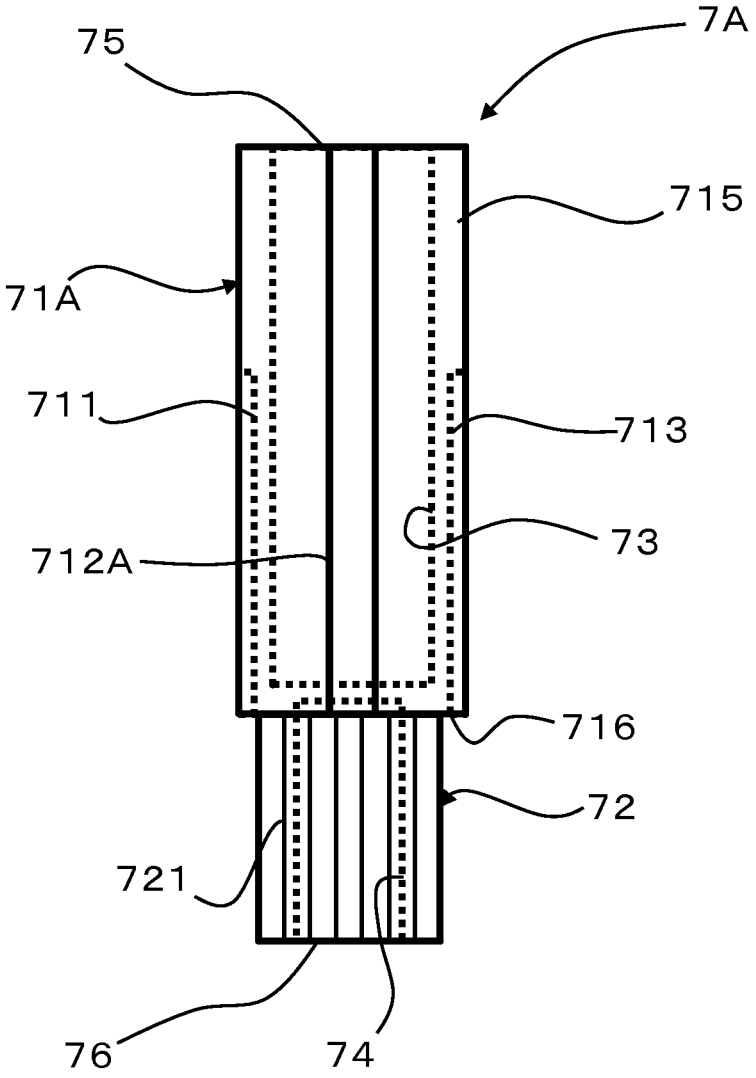
FIG. 10B is a side view schematically illustrating the body of the sleeve system in another mode.
Figure 11A:
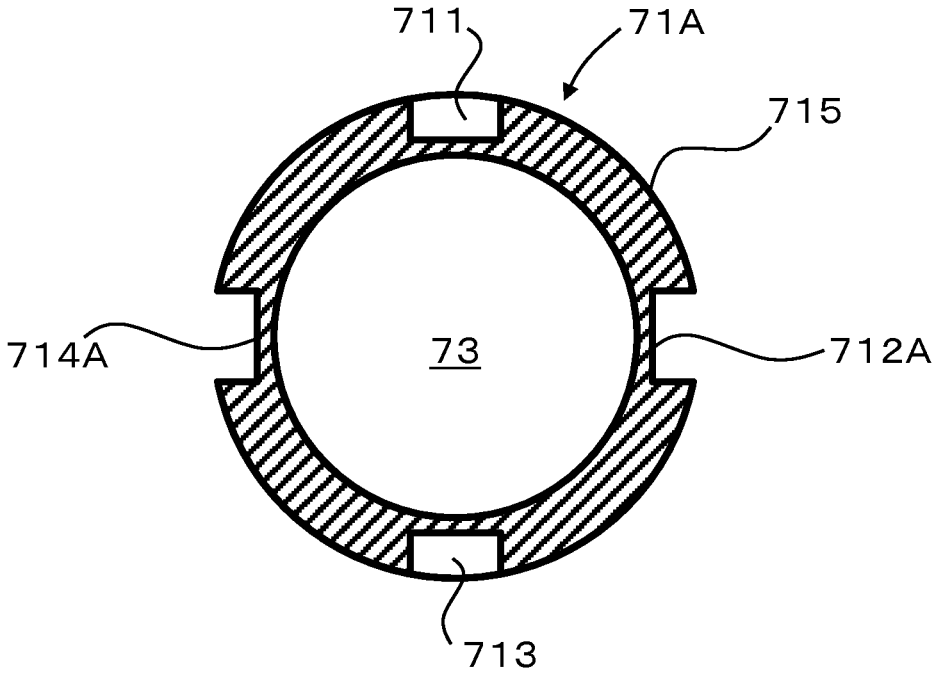
FIG. 11A is a sectional view taken along the line D-D in FIG. 10A.
Figure 11B:
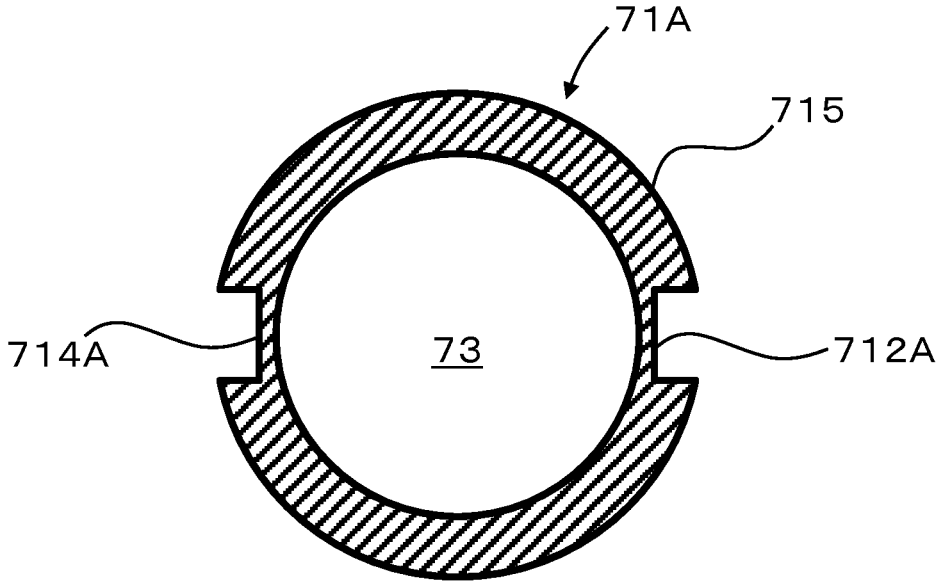
FIG. 11B is a sectional view taken along the line E-E in FIG. 10A.
Figure 12A:
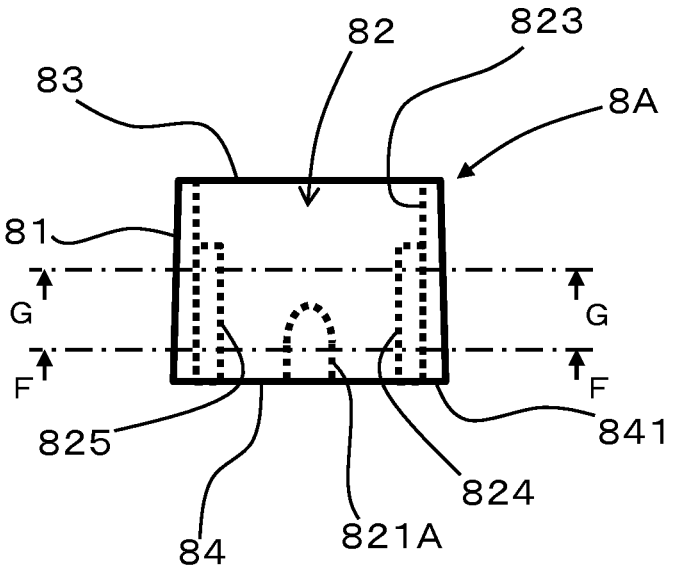
FIG. 12A is a front view schematically illustrating the adaptor of the sleeve system in another mode.
Figure 12B:
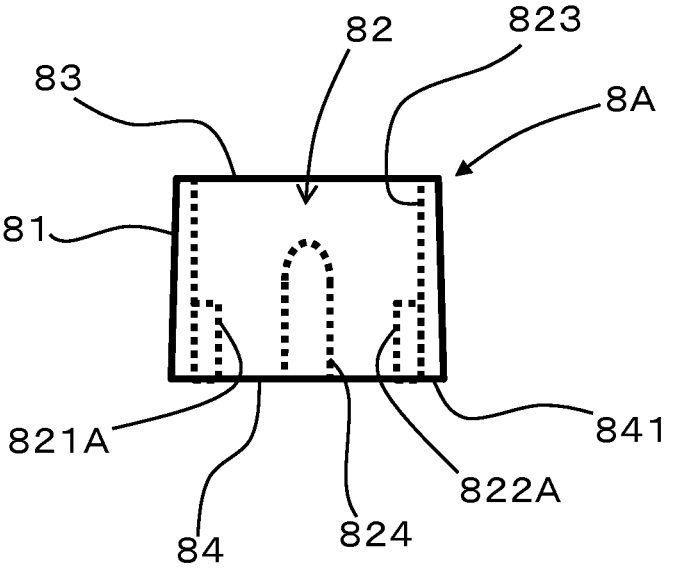
FIG. 12B is a side view schematically illustrating the adaptor of the sleeve system in another mode.
Figure 13A:
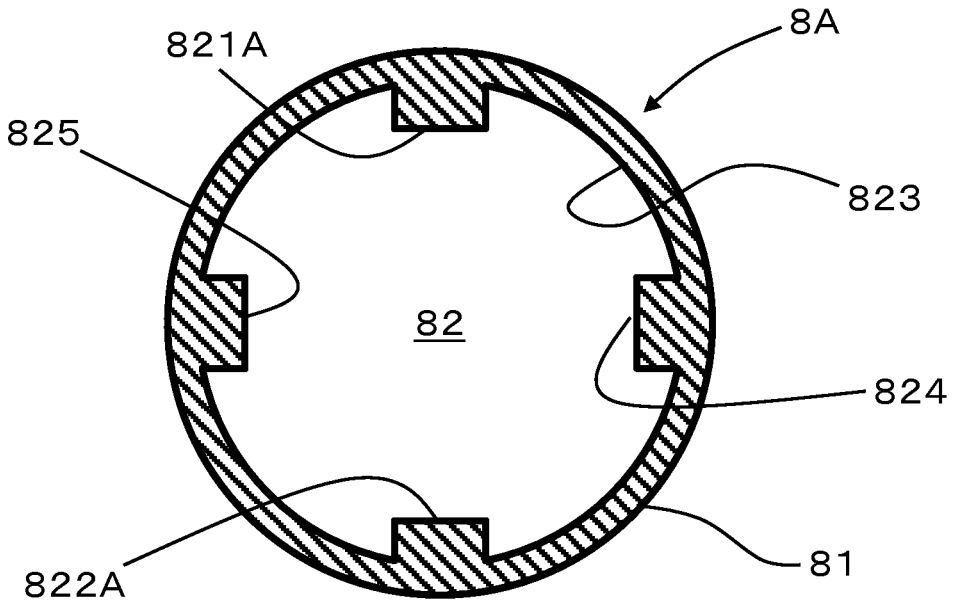
FIG. 13A is a sectional view taken along the line F-F in FIG. 12A.
Figure 13B:
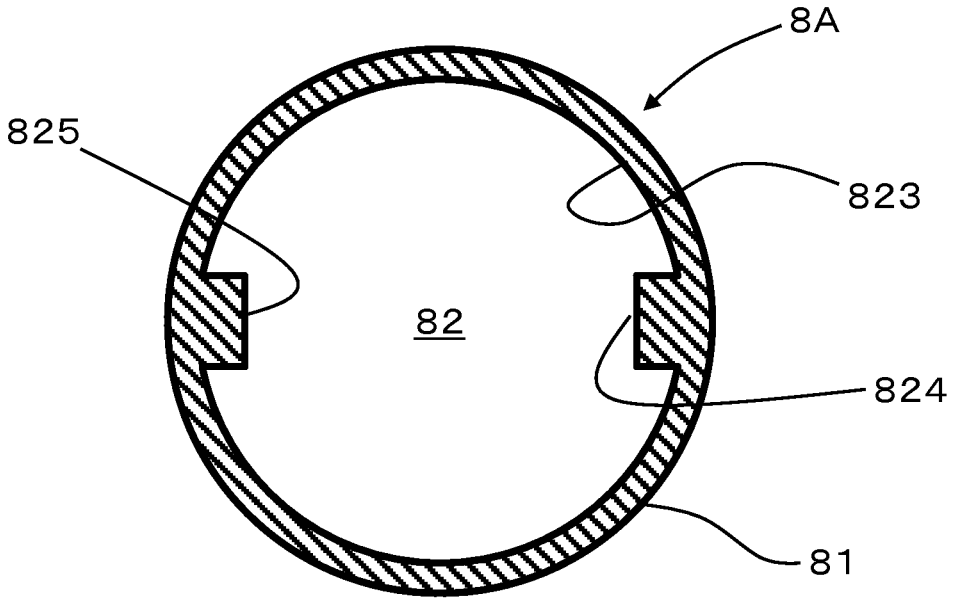
FIG. 13B is a sectional view taken along the line G-G in FIG. 12A.

FIG. 10A is a front view schematically illustrating a body 7A according to a modified example. FIG. 10B is a side view schematically illustrating the body 7A according to the modified example. FIG. 11A depicts a section taken along the line D-D in FIG. 10A. FIG. 11B depicts a section taken along the line E-E in FIG. 10A. FIG. 12A is a front view schematically illustrating an adaptor 8A according to the modified example. FIG. 12B is a side view schematically illustrating the adaptor 8A according to the modified example. FIG. 13A depicts a section taken along the line F-F in FIG. 12A. FIG. 13B depicts a section taken along the line G-G in FIG. 12A.

As illustrated in FIGS. 10A, 10B, 11A and 11B, the body 7A according to the present modified example includes a second groove 712A and a fourth groove 714A disposed opposite with each other and formed in continuation from a lower end to an upper end of a first cylindrical portion 71A. Protrusions (821A, 822A, 824, 825) can be therefore unrestrictedly inserted into the grooves (712A, 714A) without engaging therewith in the axial direction. In this example, the couple of a first groove 711 and a third groove 713 of the body 7A corresponds to the "engaged portion" according to the present invention, while the second groove 712A and the fourth groove 714A correspond not to the "engaged portion" but to "auxiliary grooves" according to the present invention.

On the other hand, as depicted in FIGS. 12A, 12B, 13A and 13B, the adaptor 8A according to the modified example includes an inner peripheral surface 823 formed with four protrusions (821A, 822A, 824, 825) extending in the axial direction. Similarly to the four grooves 711-714 according to the embodiment, the four protrusions (821A, 822A, 824, 825) are disposed at the equal interval in the periaxial direction. Note that the following discussion designates the protrusions (824, 825) as a third protrusion 824 and a fourth protrusion 825 respectively for the convenience of explanation.

This modified example is based on substantially the same principle as the principle of the embodiment described above, and provides a configuration enabling a variation of an axis-directional position in which the adaptor 8A engages with the body 7A. To be specific, the first protrusion 821A and the second protrusion 822A are disposed opposite with each other and terminate in the same position on the side of the upper end 83. The third protrusion 824 and the fourth protrusion 825 are also disposed opposite with each other and terminate in the same position on the side of the upper end 83. The adaptor 8A can be therefore attached to the body 7A not to come off on the side of the upper end 75 by selecting and engaging any one of the two couples of protrusions (821A, 822A) and protrusions (824, 825) with the grooves (711, 713).

Herein, the terminating position of the first protrusion 821A and the second protrusion 822A is different from the terminating position of the third protrusion 824 and the fourth protrusion 825. The first protrusion 821A and the second protrusion 822A terminate more downward in the axial direction than the third protrusion 824 and the fourth protrusion 825 terminate. Accordingly, the axis-directional engagement position of the adaptor 8A upon engaging the protrusions (821A, 822A) with the grooves (711, 713) is more upward than the axis-directional engagement position of the adaptor 8A upon engaging the protrusions (824, 825) with the grooves (711, 713).

In other words, the protrusions (821A, 822A) engage with the grooves (711, 713), in which case a depth of insertion of the shaft 20 into the hosel 5 increases, while the club length decreases. By contrast, the protrusions (824, 825) engage with the grooves (711, 713), in which case the depth of insertion of the shaft 20 into the hosel 5 decreases, while the club length increases. According to the modified example, the club length can be therefore adjusted by selecting the couple of protrusions that engage with the two grooves (711, 713). Namely, the couple of protrusions (821A, 822A) and another couple of protrusions (824, 825) correspond to the "engaging portions" according to the present invention.

Note that the number of protrusion(s) to configure the engaging portion may not be "2" but may be "1" and may also be equal to or larger than "3". The number of the engaging portions formed on the adaptor 8A may not be "2" but may be equal to or larger than "3". The body 7A may be formed with not the grooves but the protrusions. The adaptor 8A may be formed with not the protrusions but the grooves corresponding to this configuration. It may be sufficient that the grooves and the protrusions are disposed not strictly at the equal intervals but at the spacings. It maybe also sufficient that the second groove 712A and the fourth groove 714A are, when any one couple of protrusions engage with the couple of grooves (711, 713), configured to prevent another couple of protrusions from interfering with this engagement but not configured in continuation to the upper end from the lower end of the first cylindrical portion 71A.

<4.5>

The couple of the grooves (711, 713) and the couple of the grooves (712, 714) according to the embodiment described above correspond to the "engaged portions" according to the present invention. In other words, according to the embodiment described above, the plurality (two) of engaged portions are disposed at the spacing in the periaxial direction. However, the plurality of engaged portions may also be, without being limited to the disposition given in the foregoing example, disposed in the axial direction as illustrated in, e.g., FIG. 14.

Figure 14:
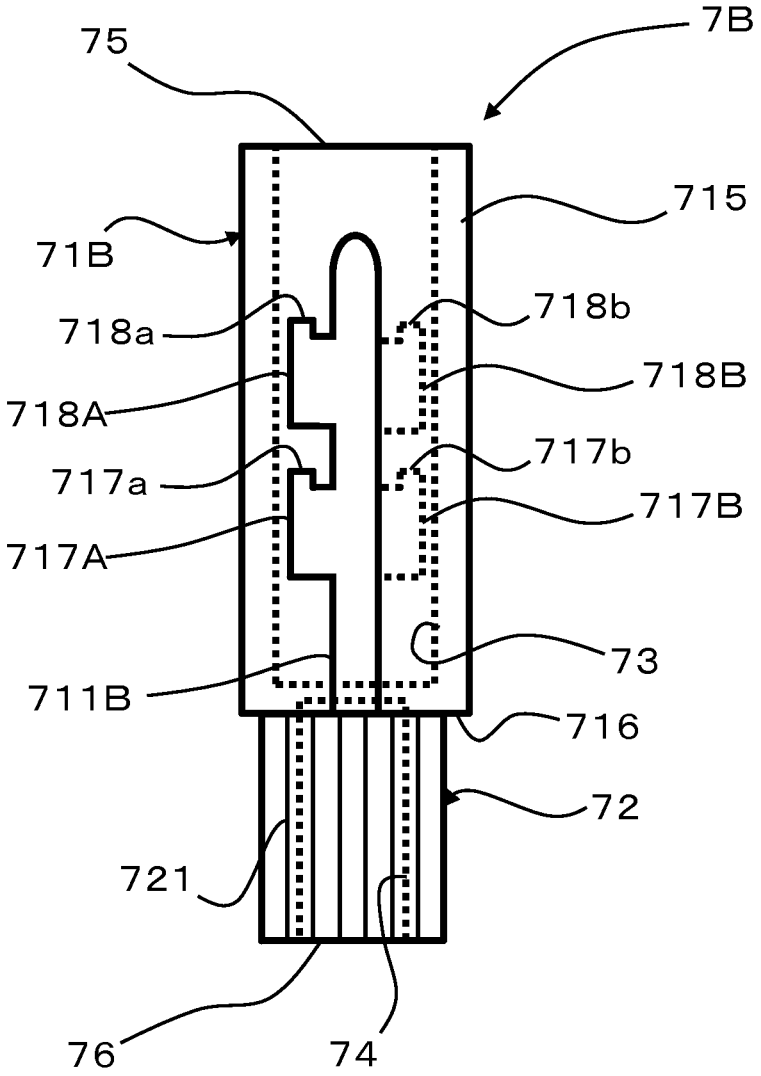
FIG. 14 is a front view schematically illustrating the body of the sleeve system in still another mode.

FIG. 14 illustrates a body 7B including the plurality of engaged portions disposed in the axial direction. Illustrations of second groove 712 and a fourth groove 714 of the body 7B are omitted. A first groove 711 includes two side grooves (717A, 718A) disposed in the axial direction but on the left side in the periaxial direction. Similarly, the third groove 713 includes two side grooves (717B, 718B) disposed in the axial direction but on the left side in the periaxial direction.

An axis-directional length of each of the side grooves (717A, 717B, 718A, 718B) corresponds to an axis-directional length of each of the protrusions (821, 822) of the adaptor 8. Consequently, the protrusions (821, 822) can engage with the side grooves (717A, 717B) or the side grooves (718A, 718B) by rotating the adaptor 8 about the body 7 leftward relatively in the periaxial direction to move the protrusions (821, 822) into the grooves (711, 713) in the axial direction. Namely, the couple of side grooves (717A, 717B) and another couple of side grooves (718A, 718B) correspond to the "engaged portions" according to the present invention. The plurality of engaged portions may be disposed as described above.

Note that the side grooves (717A, 717B, 718A, 718B) extend in a side-by-side relation with the grooves (711, 713) as depicted in FIG. 14. The side grooves (717A, 717B, 718A, 718B) are formed partially longer than the axis-directional lengths of the protrusions (821, 822) of the adaptor 8. The side grooves (717A, 717B, 718A, 718B) include recessed portions (717*a*, 717*b*, 718*a*, 718*b*) formed on the side of the upper end 75 of the body 7B. The recessed portions (717*a*, 717*b*, 718*a*, 718*b*) are separated from the grooves (711, 713) in the peripheral direction. The body 7B is secured to the hosel 5 by using the fixture 9 after mounting the adaptor 8 to the body 7B, in which case the adaptor 8 receives a force acting upward in the axial direction from the hosel 5 with respect to the body 7B. The protrusions (821, 822) of the adaptor 8 consequently engage to attach in the recessed portions (717*a*, 717*b*) of the side grooves (717A, 717B) or the recessed portions (718*a*, 718*b*) of the side grooves (718A, 718B). The adaptor 8 can be therefore made difficult to rotate about the body 7 in the periaxial direction after the protrusions (821, 822) have engaged with the side grooves (717A, 717B) or the side grooves (718A, 718B).

<4.6>

According to the embodiment described above, when varying the direction (the position in the peripheral direction) for attaching the adaptor 8 to the body 7, the adaptor 8 is required to move downward in the axial direction with respect to the body 7 till the upper end of each of the protrusions (821, 822) is located more downward than the lower end of the first cylindrical portion 71. In this connection, as illustrated in FIG. 15, an operation of the modification may be facilitated by providing a concavity 719 via which the grooves 711-714 communicate with each other.

Figure 15:
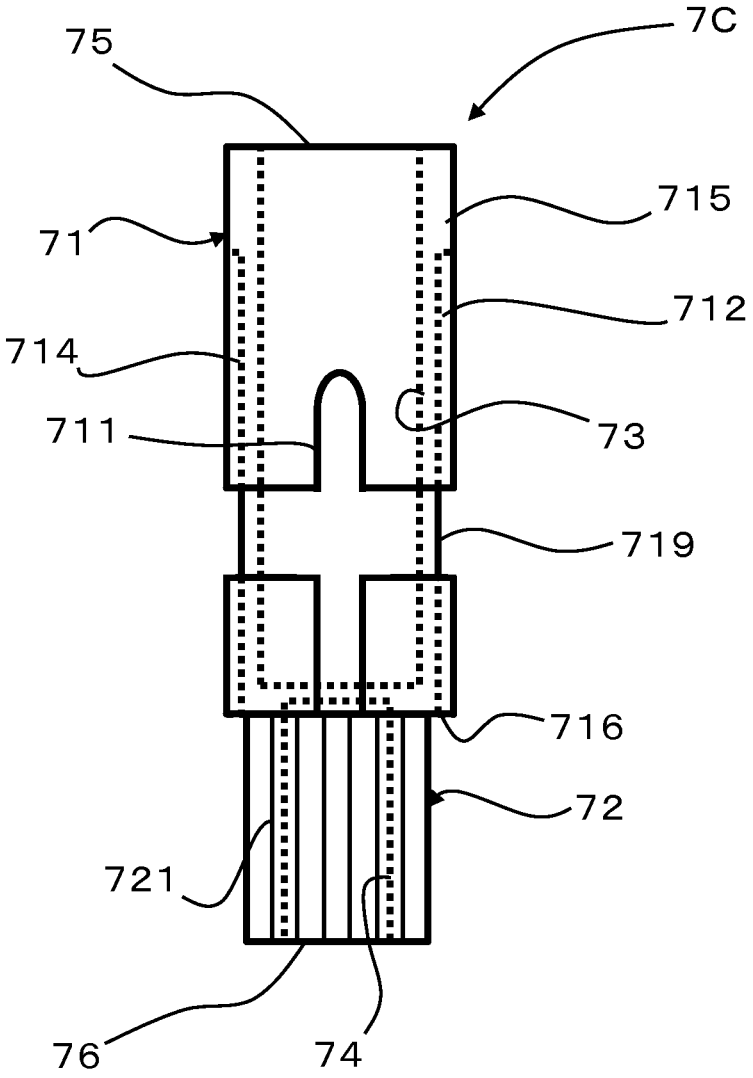
FIG. 15 is a front view schematically illustrating the body of the sleeve system in yet another mode.

FIG. 15 illustrates a body 7C provided with the concavity 719. An outer peripheral surface of the body 7C is formed with the concavity 719 extending in the periaxial direction. The concavity 719 communicates with the grooves 711-714 in a position lower than the terminals of the grooves 711-714. The concavity 719 has a configuration enabling insertion of each protrusions (821, 822). In other words, an axis-directional length of the concavity 719 is set corresponding to the axis-directional length of each of the protrusions (821, 822). Therefore, the grooves, with which the protrusions (821, 822) engage, can be modified by inserting the protrusions (821, 822) through the concavity 719 without removing the adaptor 8 from the body 7 (at least the first cylindrical portion 71).

Note that the grooves 711-714 communicate with each other via the concavity 719 in the position lower than the terminals of the grooves 711-714. Consequently, the upper ends of the protrusions (821, 822) abut on the terminals of the grooves 711-714, on which occasion, with no interference of the concavity 719, the adaptor 8 is prevented from rotating about the body 7 in the periaxial direction.

<4.7>

The embodiment described above involves forming the grooves as the engaged portion in the body 7 and forming the protrusions as the engaging portion on the adaptor 8. The relation between the engaging portion and the engaged position is not, however, limited to the example given above. The engaged portion of the body 7 maybe configured by the protrusion, while the engaging portion of the adaptor 8 may also be configured by the groove.

Incidentally, it may be sufficient in this case that an after-mentioned groove is formed in the inner peripheral surface of the adaptor 8 in order to configure the adaptor 8 not to come off the body 7 in such a direction as to separate from the hosel 5. To be specific, the groove of the adaptor 8 may be configured to open not on the side of the lower end 84 but on the side of the upper end 83, to extend in the axial direction from the upper end 83 and to terminate on the side of the lower end 84. With this configuration, when the adaptor 8 is attached to the body 7 from the lower end 76, the protrusion formed on the outer peripheral surface of the body 7 abuts on the terminal of the groove on the side of the lower end 84, with the result that the adaptor 8 is disabled from moving toward the upper end 75. The adaptor 8 can be therefore configured not to come off the body 7 in such a direction as to separate from the hosel 5. This example of replacing the protrusion and the groove with each other is described with reference to FIGS. 16A, 16B, 17A and 17B.

Figure 16A:
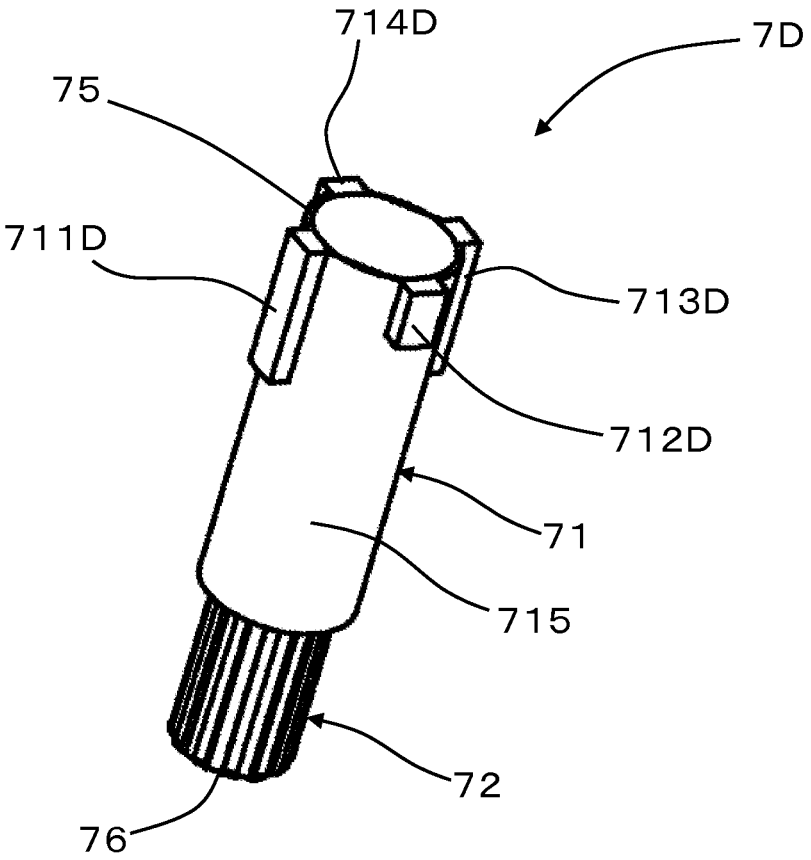
FIG. 16A is a perspective view schematically illustrating the body of the sleeve system in yet another mode.
Figure 16B:
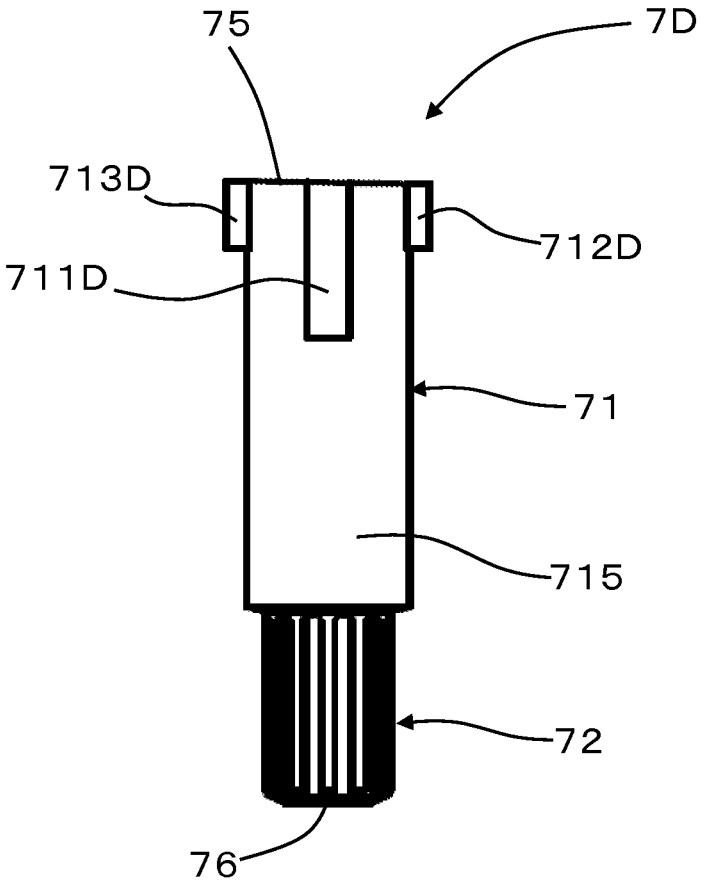
FIG. 16B is a side view schematically illustrating the body of the sleeve system in yet another mode.
Figure 17A:
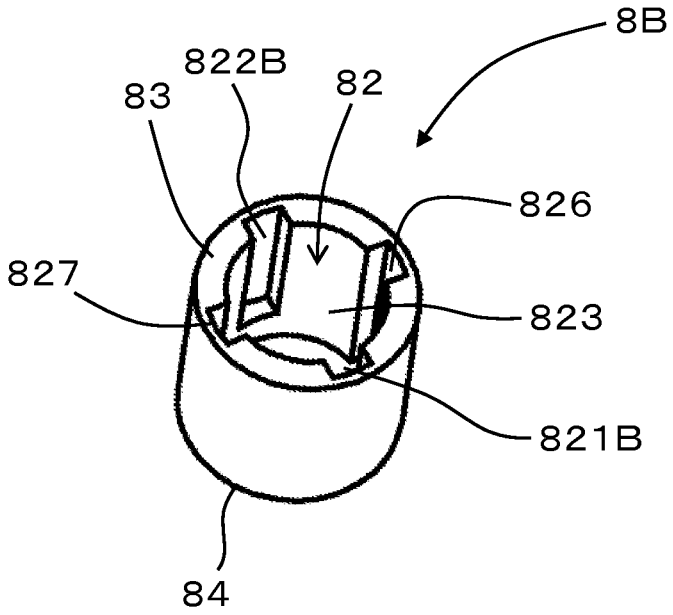
FIG. 17A is a perspective view schematically illustrating the adaptor of the sleeve system in a further mode.
Figure 17B:
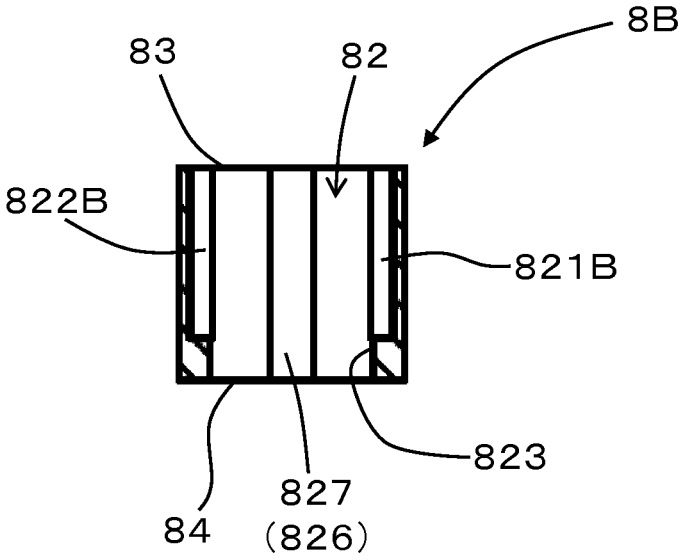
FIG. 17B is a sectional view schematically illustrating the adaptor of the sleeve system in the further mode.

FIG. 16A is a perspective view illustrating a body 7D according to the modified example. FIG. 16B is a side view illustrating the body 7D according to the modified example. FIG. 17A is a perspective view illustrating an adaptor 8B according to the modified example. FIG. 17B is a sectional view illustrating the adaptor 8B according to the modified example.

As illustrated in FIGS. 16A and 16B, four protrusions 711D-714D corresponding to the four grooves 711-714 in the embodiment are formed on an outer peripheral surface 715 of the body 7D according to the present modified example. The protrusions 711D-714D protrude outward in the radial direction and extend in the axial direction. The first protrusion 711D and the third protrusion 713D are disposed opposite with each other, and terminate in the same position in the axial direction on the side of the lower end 76. Similarly, the second protrusion 712D and the fourth protrusion 714D are disposed opposite with each other, and terminate in the same position in the axial direction on the side of the lower end 76.

The second protrusion 712D and the fourth protrusion 714D terminate in a position different from the terminating position of the first protrusion 711D and the third protrusion 713D. Specifically, the second protrusion 712D and the fourth protrusion 714D terminate closer to the upper end 75 than the first protrusion 711D and the third protrusion 713D terminate. The couple of protrusions (711D, 713D) and another couple of protrusions (712D, 714D) correspond to the "engaged portions" according to the present invention. The couple of protrusions (711D, 713D) correspond to the couple of grooves (711, 713), while another couple of protrusions (712D, 714D) correspond to the couple of grooves (712, 714). Note that the protrusions 711D-714D may not be formed to cause upper end portions thereof to reach the upper end 75.

On the other hand, as depicted in FIGS. 17A and 17B, the inner peripheral surface 823 of the adaptor 8B according to the present modified example is formed with four grooves (821B, 822B, 826, 827) corresponding to the four protrusions 711D-714D of the body 7D and being disposed at the equal intervals in the periaxial direction. The grooves (821B, 822B, 826, 827) open on the side of the upper end 83, and hence the adaptor 8B can be attached to the body 7D from the lower end 76.

The grooves (826, 827) disposed opposite with each other open also on the side of the lower end 84, while the grooves (821B, 822B) disposed opposite with each other do not open on the side of the lower end 84 but terminate in a position slightly upward from the lower end 84. Consequently, on the occasion of attaching the adaptor 8B to the body 7D from the lower end 76, the lower end portions of any one of the two couples of protrusions (711D, 713D) and (712D, 714D) abut on the lower end portions (terminals) of the couple of grooves (821B, 822B), thereby preventing the adaptor 8B from coming off the body 7D from the upper end 75 as described above. The couple of grooves (821B, 822B) terminates in the same position on the side of the lower end 84 in the axial direction, and corresponds to the "engaging portion" according to the present invention. In other words, the grooves (821B, 822B) correspond to the protrusions (821, 822).

Note that a state of causing the two grooves (821B, 822B) of the adaptor 8B to engage with the two protrusions (711D, 713D) of the body 7D, corresponds to the state of the first position described above. A state of causing the two grooves (821B, 822B) of the adaptor 8B to engage with the two protrusions (712D, 714D) of the body 7D, corresponds to the state of the second position described above. In every state, the two grooves (826, 827) receive the insertion of the two protrusions not selected, as the two protrusions engaging with the two grooves (821B, 822B) of the adaptor 8B, from the two protrusions (711D, 713D) and the two protrusions (712D, 714D). In other words, the grooves (826, 827) are used as the auxiliary grooves to receive the insertion of the protrusions, not used for positioning the adaptor 8B in the axial direction, of the body 7D.

<4.8>

The outer peripheral surface 81 and the inner peripheral surface 823 of the adaptor 8 are formed in the cylindrical shape in the embodiment discussed above. However, an external shape of the adaptor 8 may be, without being limited to the example described above, properly varied corresponding to the embodiment. For example, the outer peripheral surface 81 and the inner peripheral surface 823 of the adaptor 8 may also be formed in a polygonal shape and an elliptical shape. Similarly, the external shape of the body 7 may also be properly varied.

<4.9>

In the embodiment described above, each of the protrusions (821, 822) of the adaptor 8 takes the rectangular shape protruded inwards in the radial direction from the inner peripheral surface 823. The shape of each of the protrusions (821, 822) of the adaptor 8 may be, however, without being limited to the example given above, varied properly corresponding to the embodiment. Hereinafter, FIGS. 18A-18C depict modified examples of the external shape of each of the protrusions (821, 822) of the adaptor 8.

Figure 18A:
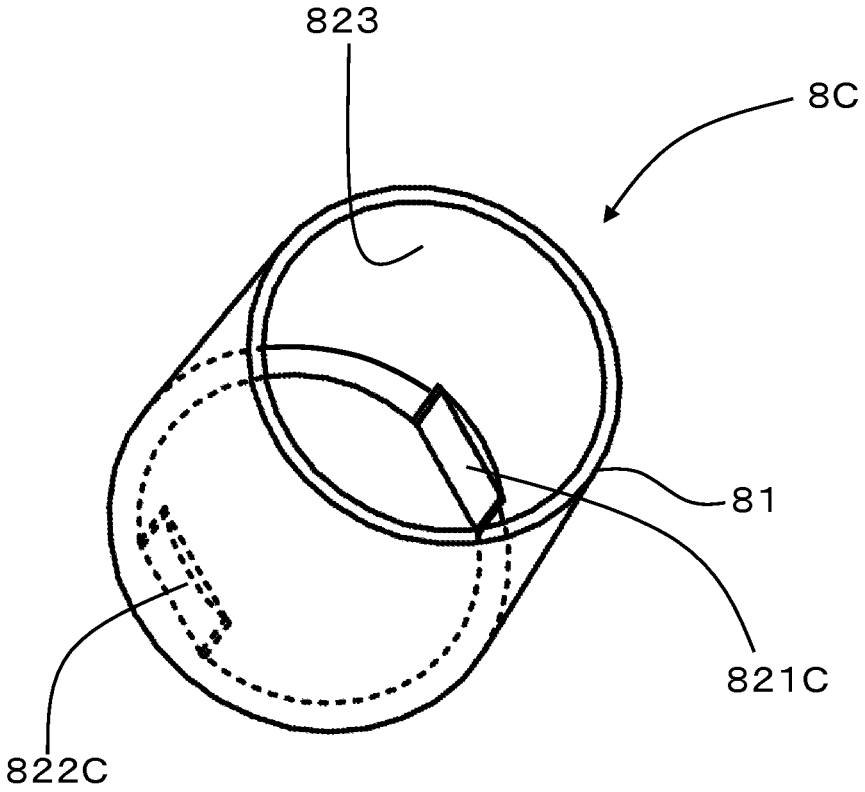
FIG. 18A is a perspective view schematically illustrating the adaptor of the sleeve system in the yet further mode.
Figure 18B:
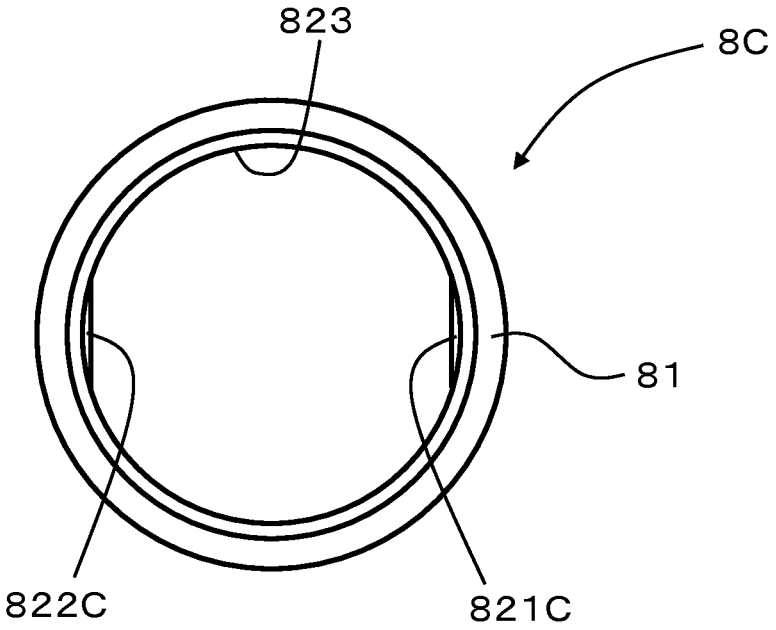
FIG. 18B is a plan view schematically illustrating the adaptor of the sleeve system in yet further mode.
Figure 18C:
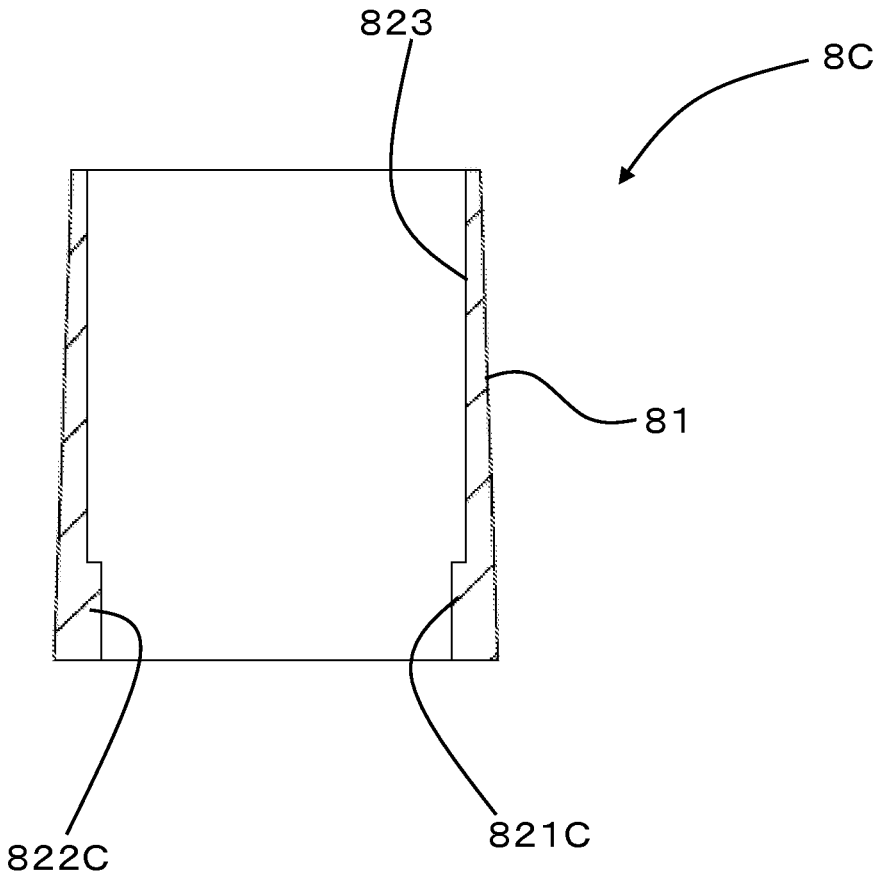
FIG. 18C is a sectional view schematically illustrating the adaptor of the sleeve system in the yet further mode.

FIGS. 18A-18C are a perspective view, a plan view and a sectional view each schematically illustrating the adaptor 8C of the sleeve system 6 according to another aspect. As illustrated in FIGS. 18A-18C, each of the protrusions (821C, 822C) may be formed as a stepped portion by providing a flat surface in a part of the circular inner peripheral surface 823.

Figure 19:
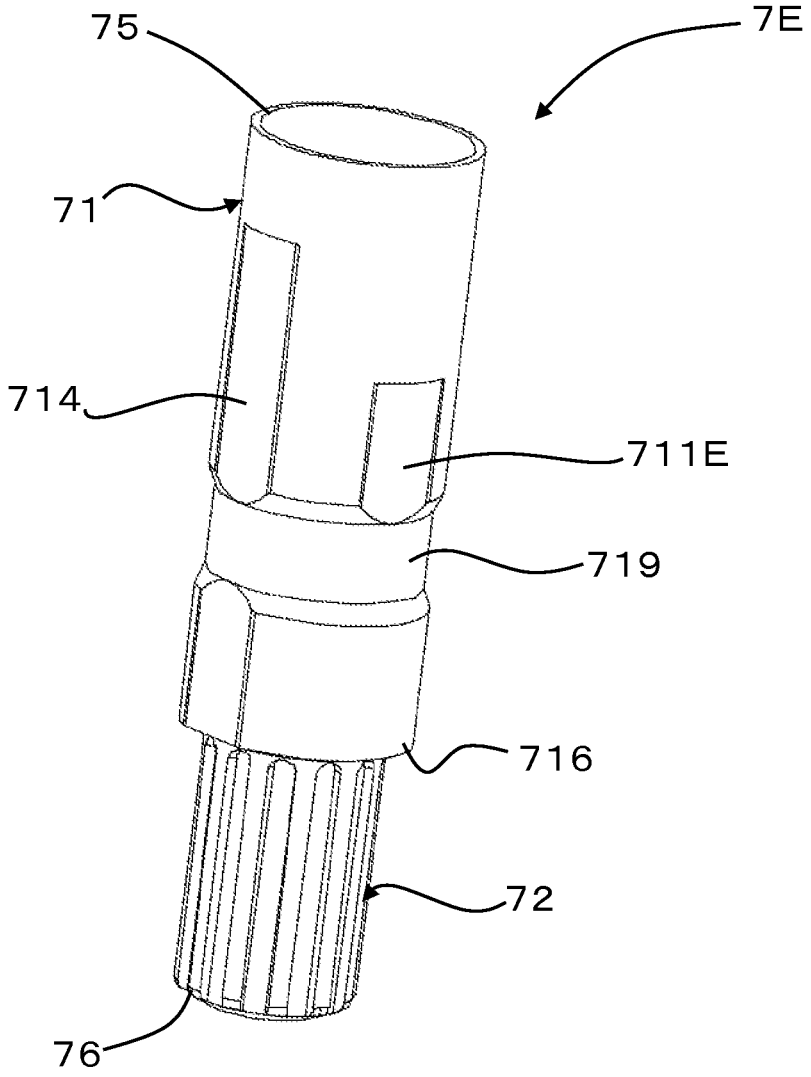
FIG. 19 is a perspective view schematically illustrating the body of the sleeve system in the yet further mode.

FIG. 19 is a perspective view illustrating a body 7E used together with the adaptor 8C. Though not illustrated in FIG. 19, a third groove similar to a first groove 711E is provided in a position opposite to the first groove 711E. Further, a second groove similar to a fourth groove 714 is provided in a position opposite to the fourth groove 714. The body 7E is herein provided with the concavity 719 as in the case of the body 7C. With this concavity 719 being provided, all of the grooves may not open on the side of the lower end 76. In other words, all of the grooves may not reach the end face 716, and it may be sufficient that a part of the grooves extend to the concavity 719 from the upper end 75. The body 7E illustrated in FIG. 19 includes the first groove 711E (and the third groove) extending only toward the upper end 75 from the concavity 719 but not reaching the end face 716. The insertion of the first protrusion 821C and the second protrusion 822C of the adaptor 8C into the first groove 711E and the third groove may simply involve inserting the first protrusion 821C and the second protrusion 822C up to the concavity 719 along the second groove and the fourth groove 714. The first protrusion 821C and the second protrusion 822C of the adaptor 8C can be thereby inserted into the first groove 711E and the third groove via the concavity 719.

<4.10>

In the embodiment described above, the use-for-shaft recessed portion 73 is formed to extend along the axial line (in the vertical direction in FIGS. 5A and 5B) of the body 7. However, the shape of the use-for-shaft recessed portion 73 may be, without being limited to the example described above, properly selected corresponding to the embodiment. For example, the use-for-shaft recessed portion 73 may be configured to extend with an inclination from the axial line of the body 7. This configuration enables fixation of the axial center S (see FIG. 1) of the shaft 20 so as to extend with the inclination from the axial line of the body 7.

<4.11>

The golf club head 10 according to the embodiment described above has the hollowed structure. The golf club head 10 may be therefore manufactured by joining two or more members. To be specific, the golf club head 10 may be manufactured by joining the head body formed with one or two or more apertures communicating with the hollowed portion to another member that seals the aperture. For instance, the crown 2 and the face 1 are constructed respectively of different members, and the head 10 can be configured by assembling the crown 2, the face 1 and the head body together. Further, the head 10 can be also configured by forming the head body including the aperture provided in the sole 3 or the side 4 and sealing this aperture with the different member. This head body can be manufactured by, e.g., a lost wax precision casting process and other equivalent methods.

What is claimed is:

1. A golf club comprising:

1) a shaft;

2) a golf club head formed with a hosel extending along an axial direction, the hosel having a top hole into which a sleeve system is partially inserted, and a bottom hole through which a threaded portion of a screw is inserted, wherein the top hole is furthest from a sole of the golf club head in the hosel axial direction; and 3) the sleeve system, said sleeve system comprising:

A) a cylindrical shaped body extending along an axial direction and partially inserted into the hosel top hole with a bottom end portion, and a top end portion, wherein the bottom end portion of the body touches the bottom hole of the hosel, said body comprising:

I) grooves of different length on a peripheral surface of the body each formed starting at the same axial position in the bottom end portion and each groove of the grooves of different length terminating at axially different positions in the top end portion;

II) a top aperture, through which the shaft is inserted, extending at least through the top end portion towards the bottom end portion, and attaching to a tip of the shaft; and III) a bottom aperture extending axially within the bottom end portion, through which the threaded portion of the screw is inserted and containing threading to engage the treaded portion of the screw, said screw securing the body by tension across the screw between the threading of the body and, by way of a head of the screw, a bottom surface of the hosel bottom hole; and B) a hollow cylindrical shaped adaptor with a portion sitting on a top surface of the hosel and a protrusion portion extending partially across the hole of the hosel, said protrusion portion:

i) permitting the body to lock into axially different positions by:

a) introduction of the protrusion portion of the adaptor into a respective groove of the grooves of different length of the body by rotation of the adaptor, followed by b) sliding the protrusion portion of the adaptor or the respective groove of the body to selectively engage the protrusion portion with the respective termini of the respective groove thereto introduced into, and ii) providing compression across the adaptor between the top surface of the hosel and the engaged groove of the body thus preventing the adaptor from coming off of the golf club.

2. The golf club of claim 1, wherein the grooves on the peripheral surface of the body are linear.

* * * * *